US010844608B2

(12) United States Patent
Ausseur et al.

(10) Patent No.: US 10,844,608 B2
(45) Date of Patent: Nov. 24, 2020

(54) CLADDING SYSTEM

(71) Applicant: OLDCASTLE BUILDING PRODUCTS CANADA INC., Saint-John (CA)

(72) Inventors: Frédéric Ausseur, Montréal (CA); Michel Bouchard, Rivière-des-Prairies (CA); Bertin Castonguay, Magog (CA); Nader Assad, Repentigny (CA); Martin Latour, Montréal (CA)

(73) Assignee: Oldcastle Building Products Canada Inc., Saint-John (CA)

( * ) Notice: Subject to any disclaimer, the term of this patent is extended or adjusted under 35 U.S.C. 154(b) by 84 days.

(21) Appl. No.: 15/758,311

(22) PCT Filed: Sep. 9, 2016

(86) PCT No.: PCT/CA2016/051065

§ 371 (c)(1),
(2) Date: Mar. 7, 2018

(87) PCT Pub. No.: WO2017/041178

PCT Pub. Date: Mar. 16, 2017

(65) Prior Publication Data

US 2018/0209154 A1 Jul. 26, 2018

Related U.S. Application Data

(60) Provisional application No. 62/217,439, filed on Sep. 11, 2015.

(51) Int. Cl.

| | |
|---|---|
| ***E04F 13/08*** | (2006.01) |
| ***E04F 13/072*** | (2006.01) |
| *E04F 13/14* | (2006.01) |

(52) U.S. Cl.
CPC ..... *E04F 13/0832* (2013.01); *E04F 13/072* (2013.01); *E04F 13/0835* (2013.01);
(Continued)

(58) Field of Classification Search
CPC . E04F 13/08; E04F 13/22; E04F 13/24; E04F 13/0832; E04F 13/0835;
(Continued)

(56) References Cited

U.S. PATENT DOCUMENTS 3,071,827 A * 1/1963 Van Buren, Jr. ..... F16B 15/06 52/511
4,299,069 A 11/1981 Neumann
(Continued)

FOREIGN PATENT DOCUMENTS

CA 1 169 265 A 6/1984
CA 2 127 191 A1 10/1994
(Continued)

OTHER PUBLICATIONS

International Search Report and Written Opinion of the International Searching Authority for corresponding International Patent Application No. PCT/CA2016/051065 dated Nov. 10, 2016, 8 pages.
(Continued)

*Primary Examiner* — Ryan D Kwiecinski
*Assistant Examiner* — Matthew J Gitlin
(74) *Attorney, Agent, or Firm* — Merchant & Gould P.C.

(57) ABSTRACT

A cladding system for covering an exterior wall is provided. The cladding system includes a panel for assembling on the exterior wall and an anchor for securing the panel to the exterior wall. The panel has a body with channels formed on a rear side thereof for draining water on an interior surface of the channel which is spaced away from the exterior wall. The anchor comprises tabs for fitting in to the channels and
(Continued)

preventing a pull-out and/or a push-in of the panel relative to the exterior wall. The anchor cooperates with the panel to direct water into the drainage channels, and to define a continuous drainage path from top to bottom of the cladding system.

40 Claims, 27 Drawing Sheets

(52) U.S. Cl.
CPC ..... *E04F 13/0869* (2013.01); *E04F 13/0873* (2013.01); *E04F 13/141* (2013.01); *E04F 2290/00* (2013.01)

(58) Field of Classification Search
CPC . E04F 13/0869; E04F 13/0873; E04F 13/072; E04F 13/141; E04F 13/26; E04F 13/0805; E04F 2290/00; E04B 1/7069; E04B 1/7645; E04B 1/765; E04B 2/707
USPC ..... 52/302.3, 302.4, 302.6, 169.5, 309.2
See application file for complete search history.

(56) References Cited

U.S. PATENT DOCUMENTS

| | | | | |
|---|---|---|---|---|
| 4,335,549 | A | 6/1982 | Dean, Jr. | |
| 4,481,749 | A * | 11/1984 | Stirling | E04F 13/0826 52/714 |
| 4,665,675 | A | 5/1987 | Kelly | |
| 4,684,287 | A | 8/1987 | Wojciechowski | |
| 5,056,281 | A * | 10/1991 | McCarthy | E02D 31/02 405/45 |
| 5,265,389 | A * | 11/1993 | Mazzone | E04C 2/384 52/309.12 |
| 5,373,676 | A | 12/1994 | Francis et al. | |
| 5,860,257 | A * | 1/1999 | Gerhaher | E04F 13/0826 52/235 |
| 6,293,064 | B1 * | 9/2001 | Larson | E04B 1/762 52/209 |
| 7,472,523 | B2 | 1/2009 | Beck | |
| 7,694,477 | B2 | 4/2010 | Kuelker | |
| D622,419 | S | 8/2010 | King | |
| 7,997,039 | B2 | 8/2011 | Wolf et al. | |
| 8,042,309 | B2 | 10/2011 | Wolf et al. | |
| D670,009 | S | 10/2012 | Buoni | |
| D674,920 | S | 1/2013 | Buoni | |
| 8,707,649 | B2 | 4/2014 | Wilkie et al. | |
| 8,782,988 | B2 | 7/2014 | Wolf et al. | |
| 8,806,826 | B2 | 8/2014 | Mann | |
| 9,091,080 | B2 | 7/2015 | Wilkie et al. | |
| 2002/0083662 | A1 * | 7/2002 | Burton | E04B 1/7069 52/199 |
| 2007/0044402 | A1 | 3/2007 | Hess | |
| 2007/0175159 | A1 | 8/2007 | Miniter | |
| 2008/0010922 | A1 * | 1/2008 | Wagner | E04F 13/0812 52/235 |
| 2009/0007509 | A1 * | 1/2009 | Jordan | E02D 31/02 52/302.1 |
| 2009/0183453 | A1 * | 7/2009 | Koessler | E04F 13/007 52/302.3 |
| 2010/0236173 | A1 * | 9/2010 | Pacha | B32B 5/18 52/309.11 |
| 2010/0326010 | A1 | 12/2010 | Bouchard | |
| 2011/0239578 | A1 | 10/2011 | Wolf et al. | |
| 2011/0289872 | A1 * | 12/2011 | Hiscock | E04B 2/8611 52/220.1 |
| 2012/0247045 | A1 | 10/2012 | Schlough | |
| 2012/0266554 | A1 * | 10/2012 | Fifield | E04F 13/0803 52/302.1 |
| 2012/0324814 | A1 * | 12/2012 | Amend | E04F 13/0875 52/302.1 |
| 2013/0125487 | A1 | 5/2013 | Power et al. | |
| 2014/0115867 | A1 | 5/2014 | Schlough | |
| 2014/0199117 | A1 * | 7/2014 | Kikuchi | E04F 13/0846 403/380 |
| 2015/0135628 | A1 | 5/2015 | Schlough | |
| 2015/0240501 | A1 * | 8/2015 | Yang | E04F 15/02044 52/489.1 |
| 2016/0208497 | A1 * | 7/2016 | Yang | B32B 3/06 |

FOREIGN PATENT DOCUMENTS

| | | | | |
|---|---|---|---|---|
| CA | 2 521 043 | A1 | 10/2004 | |
| CA | 2 526 876 | A1 | 2/2006 | |
| CA | 2 572 708 | A1 | 8/2007 | |
| CA | 2 581 604 | A1 | 9/2008 | |
| CA | 2 714 078 | A1 | 8/2009 | |
| CA | 2 829 410 | A1 | 9/2012 | |
| CA | 2 846 124 | A1 | 10/2012 | |
| CA | 2867967 | A1 * | 4/2016 | E04F 13/0835 |
| CH | 270191 | A * | 8/1950 | E04F 13/141 |
| DE | 2257324 | A1 * | 6/1974 | E04F 13/0819 |
| DE | 102005019977 | A1 * | 11/2006 | E04F 13/0819 |
| EP | 0095407 | A1 * | 11/1983 | E04F 13/007 |
| EP | 1965003 | A2 * | 9/2008 | E04F 13/0819 |
| FR | 963869 | A * | 7/1950 | E04F 13/0885 |
| FR | 2561289 | A1 * | 9/1985 | E04F 13/141 |
| WO | WO-2012001721 | A1 * | 1/2012 | E04F 13/0875 |
| WO | WO-2018234772 | A1 * | 12/2018 | E04F 13/0805 |

OTHER PUBLICATIONS

Extended European Search Report for European Patent Application No. 16843333.2 dated Apr. 8, 2019, 5 pages.

* cited by examiner

CLADDING SYSTEM

This application is a National Stage Application of PCT/CA2016/051065, filed 9 Sep. 2016, which claims benefit of U.S. Provisional Patent Application Ser. No. 62/217,439, filed 11 Sep. 2015 and which applications are incorporated herein by reference. To the extent appropriate, a claim of priority is made to each of the above disclosed applications.

TECHNICAL FIELD

The present disclosure relates to cladding systems for buildings. More particularly, it relates to a cladding system having panels with water drainage channels provided therein.

BACKGROUND

Masonry veneer is a popular cladding for buildings. Generally, it involves building a layer of brick, stone or other masonry work to cover a structural wall. Masonry veneer is often desirable because of its aesthetic qualities, but can be labour intensive and time consuming as the masonry work must be installed in a mortar bed.

Alternatively, a veneer can be assembled using prefabricated cladding panels. These panels generally have an exterior face designed to resemble the finish of traditional masonry veneer. Advantageously, this type of cladding can be faster and easier to install as the panels can be attached directly to a structural wall and do not required the use of mortar.

In addition to providing a pleasing aesthetic, the cladding panels should preferably be designed to protect a supporting wall from the elements. More specifically, the assembled panels should be able to withstand varying weather conditions, and should be able to adequately manage moisture. Preferably still, the cladding panels should be easy to manufacture.

It is therefore desirable to provide an improved cladding system which solves at least some of the shortcomings of the prior art.

SUMMARY

According to an aspect, a cladding system for covering an exterior wall is provided. The cladding system includes a panel assemblable with other like-panels to cover the exterior wall. The panel includes a body having a front face for facing outward, a rear face for facing the exterior wall, and top, bottom and side faces for positioning proximate to faces of adjacent ones of the other like-panels. The panel includes a plurality of drainage channels formed in the rear face of the body, the plurality of drainage channels each having an interior surface spaced apart from the rear face of the body, and opening at least on the top and bottom faces of the body. The channels on the rear face of the panel define a drainage plane between the front face and the rear face of the body of the panel. The cladding system also includes an anchor engaged with the panel for securing the panel to the exterior wall. The anchor has an elongated body extending along the top face of the panel. The elongated body includes a plurality of tabs spaced-apart along the elongated body, the tabs respectively fitting in corresponding ones of the drainage channels formed in the panel. The anchor also includes a wall engagement mechanism, for securing the anchor to the exterior wall.

In an embodiment, at least one of the drainage channels in the panel includes a slotted portion receiving one of the plurality of tabs therein. The slotted portion is spaced apart from the interior surface of the corresponding drainage channel, and defines a liquid channeling portion between the interior surface and the tab, allowing liquid on the top face of the panel to flow into the drainage channel.

In an embodiment, each of the plurality of tabs includes an angled portion angled towards the interior surface of its corresponding drainage channel. The angled portion directs liquid flowing over the tab towards the interior surface.

In an embodiment, the body of the panel includes protrusions formed on its top face. The protrusions are positioned adjacent the openings of the drainage channels on the top face for blocking liquid from entering the drainage channels directly from the front face of the panel.

In an embodiment, the top face of the panel is sloped downwards from the rear face to the front face, to direct water away from the exterior wall.

In an embodiment, the bottom face of the panel is angled at approximately 90° relative to the rear face.

In an embodiment, the panel body is a molded body.

In an embodiment, the anchor further includes a wall spacing element for spacing the rear face of the panel apart from the exterior wall when assembled on the exterior wall, thereby defining a continuous air gap between the rear face of the panel and the exterior wall.

In an embodiment, the anchor further includes a panel spacing element for spacing the top face of the panel apart from the bottom face of a like-panel vertically stacked thereon by at least 1 mm when assembled on the exterior wall.

In an embodiment, the panel spacing element includes wings extending from the elongated body of the anchor, said wings abutting the bottom face of the like-panel vertically stacked thereon when assembled on the exterior wall, thereby maintaining a spacing between the top face of the panel and the bottom face of the like-panel vertically stacked thereon, and blocking water from passing therethrough.

In an embodiment, the wings extend from the elongated body of the anchor at an angle between 10° and 70°.

The exterior wall typically includes a weather resistant barrier. Accordingly, in an embodiment, the panel and/or anchor further include panel spacing elements for spacing apart at least one of the faces of the panel and at least one face of an adjacent panel. When assembled on the exterior wall to form a veneer, the panel spacing elements in the anchor and/or the panel form at least 10 times more air leakage areas in the veneer than in the WRB.

In an embodiment, the plurality of drainage channels are in fluid communication with the drainage channels of a top-adjacent panel via the channel opening on the top face, and with the drainage channels of a bottom-adjacent panel via the drainage channel opening on the bottom face. The cladding system thereby has a continuous drainage path for water via the drainage channels from a top face of a topmost panel to a bottom face of a bottommost panel.

In an embodiment, the elongated body of the anchor includes a gutter portion for collecting liquid on the top face of the panel and directing the liquid to a nearest one of the drainage channels.

In an embodiment, the gutter portion has a substantially U-shaped profile and extends along the top face of the panel in an area between the rear face and the interior surface of the plurality of channels.

In an embodiment, the gutter portion has apertures formed therein, said apertures being aligned with the drainage channels for draining liquid collecting on the gutter portion through the drainage channels.

In an embodiment, the cladding system further includes at least one bracket engaged with the panel, the bracket having a body with a panel engagement portion engaged in a corresponding one of the plurality of drainage channels, and an anchor engagement portion for engaging with a bottom-adjacent anchor, the bracket and anchor engaging to prevent a pull-out of the panel relative to the exterior wall.

In an embodiment, the bracket is engaged in the corresponding one of the plurality of drainage channels via a press-fit in a bottom portion thereof.

In an embodiment, the wall engagement section of the anchor includes a mounting plate for mounting to the exterior wall, and the anchor further includes a bracket engagement portion which includes an elongated track extending from the mounting plate. The anchor engagement portion of the bracket includes a substantially U-shaped member shaped to fit over the elongated track and hang therefrom.

In an embodiment, the elongated track is spaced apart from the mounting plate. The drainage holes are provided in the anchor body between the elongated track and the mounting plate for allowing liquid in a plane of the exterior wall to drain onto the anchor.

In an embodiment, the bracket engagement portion includes a panel abutment portion spaced apart from the elongated track. The panel abutment portion abuts against a lower portion of the panel when the panel hangs from the elongated track member via the bracket element, thereby preventing a push-in of the panel relative to the wall structure.

In an embodiment, the cladding system further includes a starter anchor supporting a bottommost panel, the starter anchor having an elongated body extending along the bottom face of the bottommost panel. The elongated body of the starter anchor includes a mounting plate for mounting to the wall structure; and a ledge portion extending away from the mounting plate. The ledge portion includes a panel abutting member abutting against the bottom face of the bottommost panel for providing vertical support thereto.

In an embodiment, the elongated body of the starter anchor further includes a bracket engagement portion for engaging with a bracket provided in the bottommost panel, the bracket engagement portion including an elongated track member extending from the mounting plate.

In an embodiment, the ledge portion has apertures formed therein for allowing fluid flowing through the bottom face of the bottommost panel to drain therethrough.

In an embodiment, each of the plurality of drainage channels in the panel is substantially dovetail-shaped.

In an embodiment, the plurality of drainage channels are parallel to one another and run substantially rectilinearly from the top face of the panel to the bottom face of the panel.

In an embodiment, each of the plurality of channels open on the rear face of the panel.

In an embodiment, the tabs of the anchor have apertures formed in a distal end thereof, said apertures breaking water droplets, preventing a blockage of water flowing into the drainage channels from the tabs and maintaining a laminar flow of water along the interior surfaces of the channels.

In an embodiment, the front face of the panel has a substantially rectangular profile.

In an embodiment, the front face of the panel has a substantially Z-shaped profile.

In an embodiment, the anchor is removably engaged with the panel.

In an embodiment, the anchor is made of a corrosion-resistant metal.

According to another aspect, a panel assembly for assembling a cladding system on an exterior wall is provided. The panel includes: a panel body having a front face for facing outward, a rear face for facing the wall structure, and top, bottom and side faces for positioning proximate to edges of adjacent panels. The panel includes at least one drainage channel formed in the panel body, said at least one drainage channel having an interior surface spaced apart from the rear face of the panel body, and opening at least on the top and bottom faces of the panel body. The panel assembly also includes an anchor engaged with the panel body, the anchor having a wall engagement portion for securing the anchor to the wall structure, and a panel engagement portion including at least one tab engaged in the at least one drainage channel formed in the panel body.

According to another aspect, a cladding system assembled on a wall structure is provided. The cladding system includes a plurality of panels having drainage channels molded on rear sides thereof. Each of the plurality of panels is secured to the wall structure via anchors. The anchors are engaged with the panels via tabs inserted into the drainage channels. The anchors have a gutter portion extending laterally along the top edge of the panels and directing fluid on the top face of the panels towards the drainage channels. The assembled panels define a drainage plane spaced apart from the wall structure. The drainage plane includes an uninterrupted path for liquid between a topmost edge of the cladding system to a bottommost edge of the cladding system defined by the drainage channels of vertically stacked panels in fluid communication via the gutter portions of the anchors.

In an embodiment, the rear faces of the panels are spaced apart from the wall structure, defining a continuous air gap between a rear face of the assembled panels and the wall structure.

In an embodiment, the cladding system further includes a weather resistant barrier extending between the rear faces of the panels and the wall structure. The assembled panels are spaced apart from one another to define an air leakage area at least 10 times greater than that of the weather resistant barrier.

In an embodiment, the drainage channels of vertically stacked panels are aligned with one another.

In an embodiment, the anchors are removably engaged with the panels.

According to yet another aspect, a mortarless cladding or siding system is provided. The mortarless siding system includes a plurality of siding panels and anchors for securing the siding panels to a supporting wall. Each siding panel has a body with a rear side for facing the supporting wall and an outward-facing front side. Water drainage channels are provided in the siding panel body along a height thereof and open on the rear side. Each anchor includes a panel engagement mechanism removably engageable with the water drainage channels, and a mounting plate for securing the anchor to the supporting wall. By "mortarless", it is meant that the system does not need mortar to assemble the panels. Mortar can be used to fill in the gaps between the panels for aesthetic reasons, but it does not provide structural integrity to the panel system.

In an embodiment, the channels are arranged such that when the panels are stacked, the channels of vertically stacked panels align to form a continuous drainage channel along a height of the stacked panels.

In an embodiment, the channels of vertically stacked panels are out of alignment, and the anchors are configured to redirect water on a top edge of the panel towards a closest one of the drainage channels.

In an embodiment, the panels are provided with protrusions along their top or bottom edges creating spacing between stacked panels, the spacing being sized to allow water to enter therethrough and drain through the drainage channels.

In an embodiment, at least some of the protrusions are provided adjacent the drainage channels, thereby forming a first water barrier preventing water from entering the channels from an exterior of the panel.

In an embodiment, the anchors include a panel abutment portion abutting against a top edge of a panel when engaged with the channels thereof, the panel abutment portion including extensions positioned between the channels and acting as a second water barrier to direct water towards the drainage channels.

In an embodiment, the protrusions are sized and arranged such that a pressure equalization chamber is formed between stacked panels, defining open spaces thereby equalizing pressure on the front and rear sides of the panels.

In an embodiment, the protrusions are aligned with embossed features in the anchors, the embossed features securing the protrusions and preventing a pull-out or push-through movement of the panels.

In an embodiment, the embossed features are spaced-apart horizontal ribs on the panel abutting portion of the anchor, the protrusions being aligned between the ribs.

In an embodiment, the panel abutting portion of the anchor is provided with a smooth surface, thereby allowing a lateral translation of a panel stacked thereon.

In an embodiment, the drainage channels are dovetail-shaped and the anchor is provided with deflection means angled towards an interior wall of the channels, thereby directing water draining through the channel towards an interior wall of the channels.

In an embodiment, the panels are provided with lips along edges thereof for directing water towards an exterior of the panels.

In an embodiment, the adjacent panels are spaced apart, defining open spaces thereby equalizing pressure on the front and rear sides of the panels.

In an embodiment, the open spaces are sized such that the assembled panels define a veneer having more than 5,000 $mm^2$ of open space per $m^2$ and preferably approximately 10,000 $mm^2$ of open space per $m^2$.

In an embodiment, the system further includes a starter strip for securing to the supporting wall and for supporting a first row of panels. The starter strip includes a panel abutment portion for abutting against a lower edge of the panel, and a panel engagement portion for engaging with the panel.

In an embodiment, the panel engagement portion includes a tab removably engageable with the channels of the panel.

In an embodiment, the panel includes a slider and the panel engagement portion includes an abutting portion for abutting against the slider, allowing the slider to slide there along.

According to an aspect, a kit is provided for assembling a mortarless siding system. The kit includes a combination of the panel, anchor and/or starter strip described above.

According to an aspect, a method is provided for assembling a mortarless siding system. The method includes the steps of inserting tabs of an anchor into channels of a panel, and securing the anchor to a supporting wall.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, similar features in different embodiments have been given similar reference numbers. For the sake of simplicity and clarity, namely so as to not unduly burden the figures with unneeded references numbers, not all figures contain references to all the components and features; references to some components and features may be found in only one figure, and components and features of the present disclosure which are illustrated in other figures can be easily inferred therefrom.

Figure 1A:
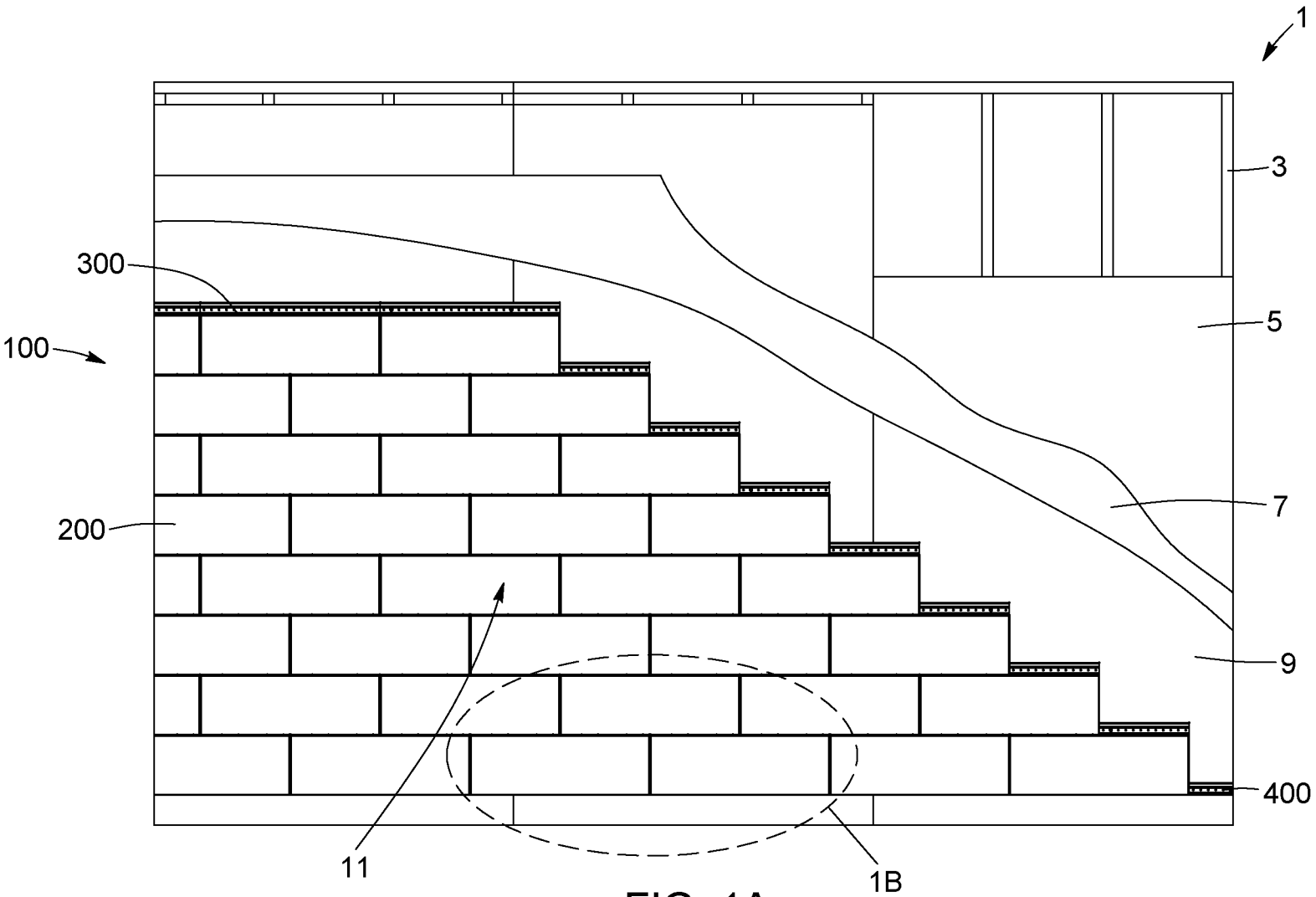
FIG. 1A is a front cutaway view of a veneer assembled on a supporting wall using a cladding system, according to an embodiment.

With reference to FIG. 1A, an embodiment of a cladding system 100 is shown assembled on a supporting wall 1. Preferably, supporting wall 1 is an exterior wall of a structure, such as a front, side or rear wall of a building or house. The cladding system 100 can also be referred to as a siding system, a fronting system or a veneer system. In the present embodiment, the supporting wall 1 comprises framing 3, sheathing 5, a weather resistant barrier (WRB) 7 and a thermal insulation layer 9 (such as a rigid EPS panel). It is appreciated, however, that other supporting wall 1 configurations are possible. For example, in some embodiments, supporting wall 1 can be an interior wall of a structure and may not require insulation.

In the illustrated embodiment, the cladding system 100 includes a plurality of panels 200 secured to the supporting wall via anchors 300, 400 and assembled to form a veneer, siding or cladding 11. In the present embodiment, the cladding system 100 can be said to be mortarless in that the panels 200 are installed and secured without the use of mortar. Instead, the anchors 300, 400 are screwed into the supporting wall 1 and provide the necessary support to adequately secure the panels 200 in an assembled configuration. It is appreciated, however, that this does not necessarily mean that no mortar is present in the system whatsoever. For example, mortar can be provided between adjacent panels for aesthetic purposes, to give the appearance that the panels 200 are traditional masonry elements assembled using mortar. Mortar may also be used to provide additional support to the panels 200 in addition to the support provided by the anchors 300, 400.

As will be described in more detail hereinafter, the anchors 300, 400 allow the panels 200 to be spaced apart from the supporting wall 1 when secured thereto, thereby defining a continuous air gap (or an air circulation plane) between the supporting wall 1 and the panels 200. Moreover, the panels 200 and anchors 300, 400 are configured to cooperate to manage water (or other liquids), making it suitable for handling moisture on the exterior walls of a building. In this sense, the cladding system 100 can also be referred to as a rain screen.

Figure 1B:
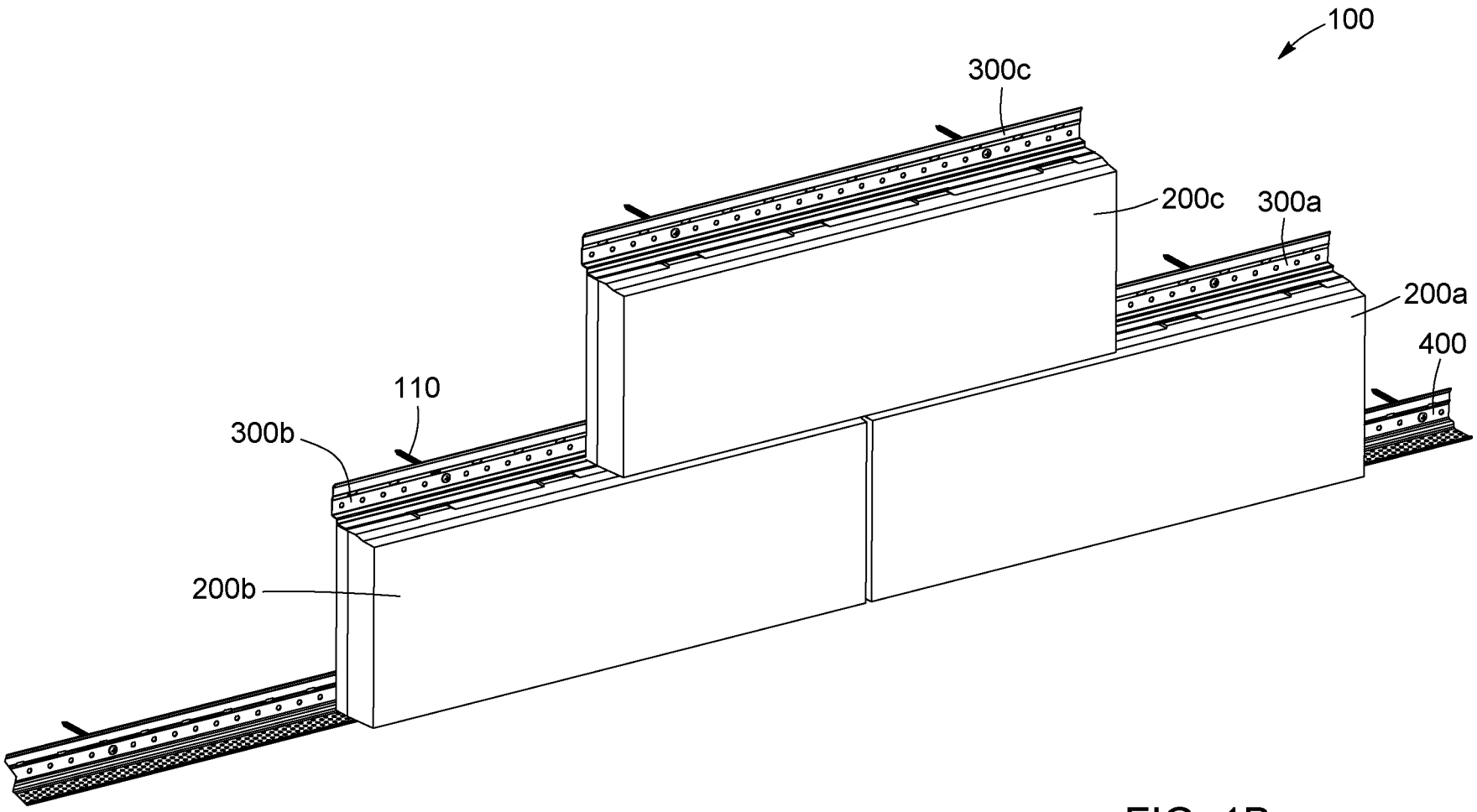
FIG. 1B is a front perspective view of a portion of the cladding system of FIG. 1A, showing three stacked panels.
Figure 1C:
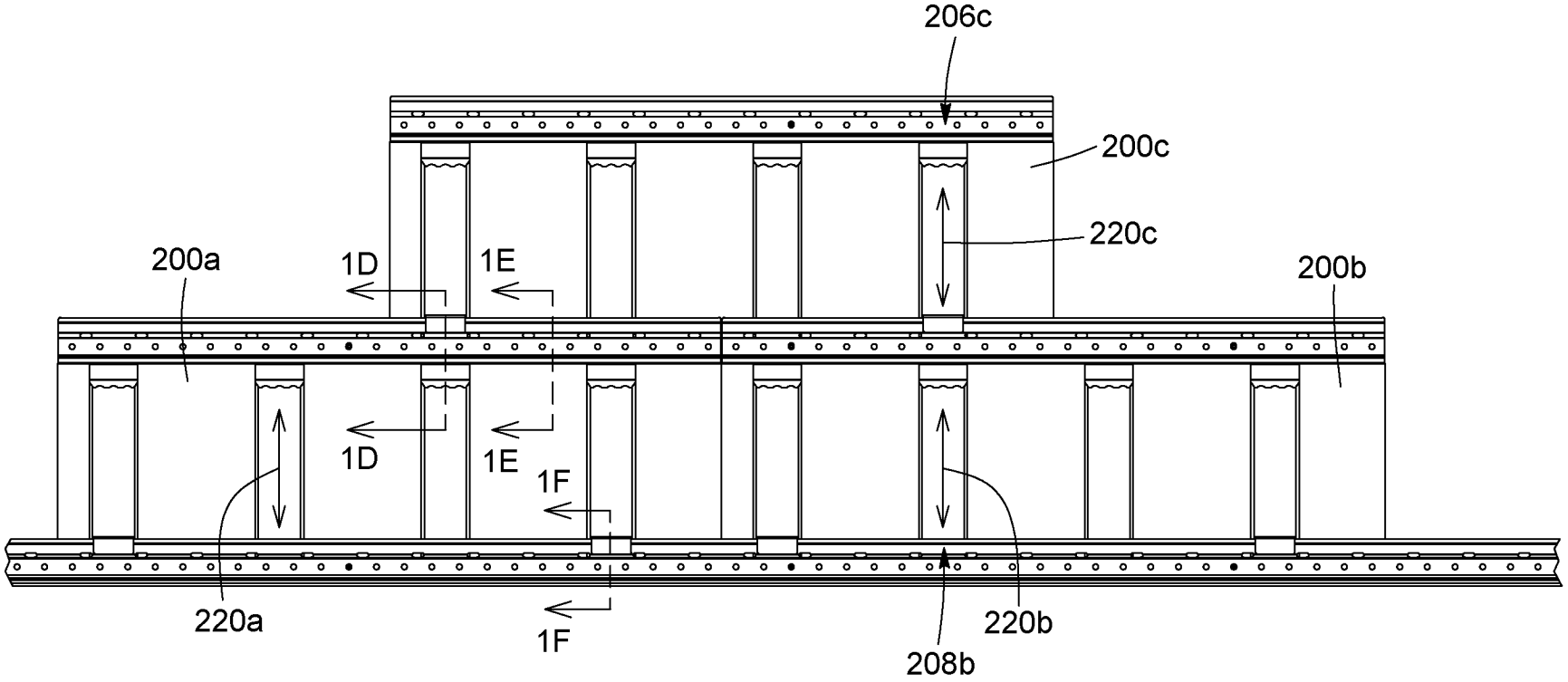
FIG. 1C is a rear view of the portion of the cladding system of FIG. 1B, showing the water drainage channels.

With reference now to FIGS. 1B and 1C, a portion of the system 100 is shown in detail. The illustrated portion includes three panels, 200*a*, 200*b* and 200*c* assembled in a staggered configuration. These panels are "like-panels" in that they have similar features and configurations. For clarity in the present illustrations, elements belonging to a particular panel are individually referenced using the letters "a", "b" or "c", whereas the elements of any panel are referred to generally without using a letter modifier. However, it is appreciated that descriptions of elements of a particular panel also apply corresponding elements on other panels.

In the present illustration, panels 200*a* and 200*b* can be referred to as the bottommost panels, as they are the panels positioned at the bottom of the veneer 11, and are supported by anchor 400, which can also be referred to as a starter strip or starter anchor. Panels 200*a* and 200*b* assembled side-by-side to one another and can be said to be side-adjacent, forming vertical joints therebetween. Panel 200*c* is stacked on top of panels 200*a* and 200*b*, and can be said to be top-adjacent thereto, forming horizontal joints therebetween. As can be appreciated, other panels 200 in the cladding system 100 can be assembled in a similar manner. Each of the panels 200*a*, 200*b*, 200*c* is attached to the supporting wall 1 and supported via corresponding anchors 300*a*, 300*b*, 300*c*, and starter anchor 400, which are themselves secured to the supporting wall with fasteners, such as screws 110. The screws 110 are driven through anchors 300*a*, 300*b*, 300*c*, and starter anchor 400, to the framing of the exterior wall. The anchors themselves engage with the panels 200*a*, 200*b*, 200*c*. Each panel is provided with a plurality of water drainage channels 220*a*, 220*b*, 220*c*, for draining water and protecting the supporting wall. The anchors and starter strips can also be referred as longitudinal guides.

With reference to FIGS. 2A to 2E, each panel 200 comprises a body 201 which is preferably unitary and moulded or casted from a settable material, such as from concrete or from a concrete-based material. It is appreciated, however, that the body can also be formed through other methods, such as extrusion, machining, etc. The body 201 has a front face 202 and a rear face 204 with top 206, bottom 208, left 210 and right 212 faces extending therebetween. When the panel 200 is installed, the rear face 204 faces the supporting wall, while the front face 202 faces outward, i.e. faces away from the supporting wall and is exposed/visible on an exterior of the supporting wall. In the illustrated configuration, when multiple panels 200 are assembled, the side and top/bottom faces 206, 208, 210 and 210 are positioned proximate side and top/bottom faces of adjacent panels. However, other configurations of the faces are possible as will be explained later in the description. The front face 202 can be decorated (ex: with textures and false joints) to resemble traditional masonry blocks and to give the assembled panels an aesthetically pleasing finish. The top face 206 and/or side faces 210, 212 can be provided with a lip, bevel or chamfer 203 for directing water to run off towards an exterior of the panel 200. For example, the top face 206 can be sloped downward from the rear face 204 to the front face 202, thereby forming the bevel 203. In the present embodiment, the top face 206 has a rear flat section and is sloped in two stages in a front section. Preferably, the bottom face 208 extends substantially at a right-angle relative to the rear face 204. In this fashion, water running down the front face 206 will be discouraged from entering through the horizontal joint between the panel 200 and another panel vertically stacked thereunder. In some embodiments, the bottom face 206 can also be sloped downward from the ear face 204 to the front face 202.

Figure 2A:
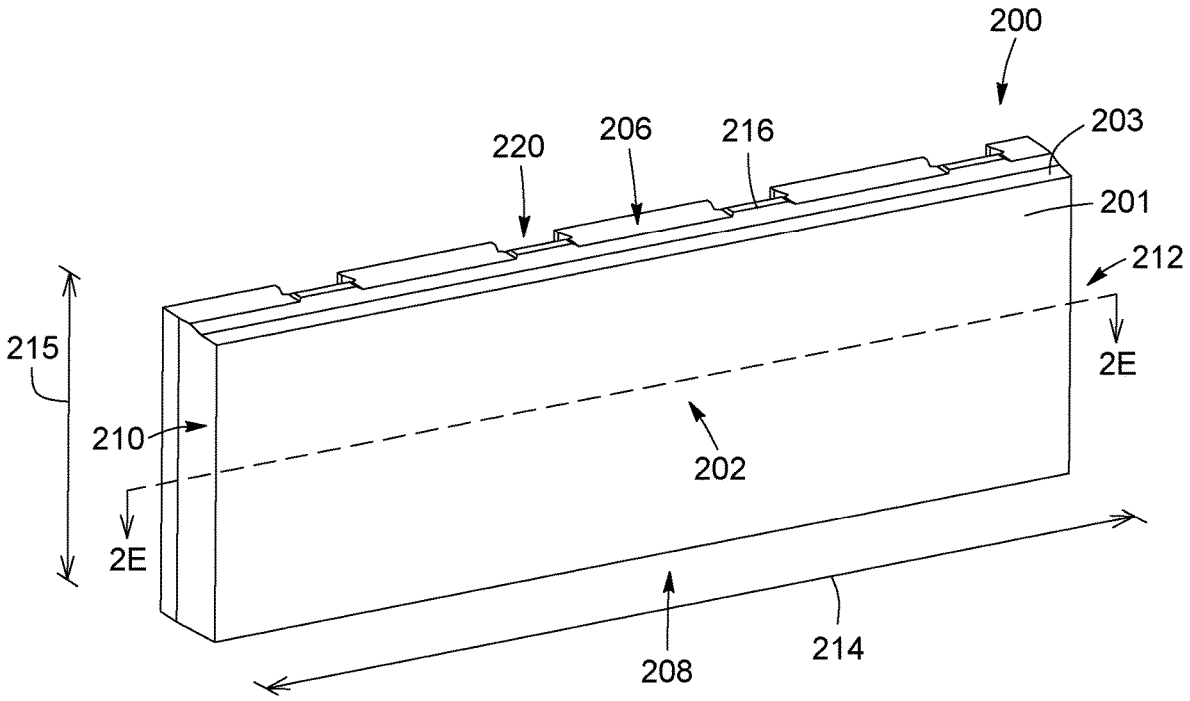
FIGS. 2A and 2B are respective front and rear perspective views of a top face of a panel according to an embodiment.
Figure 2B:
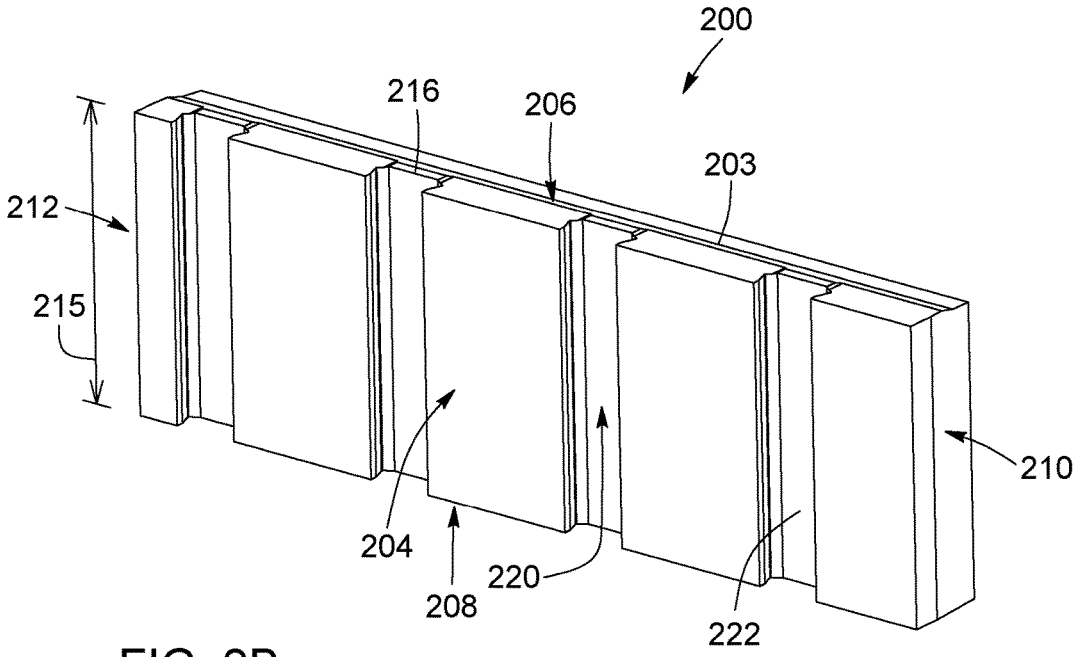
Figure 2C:
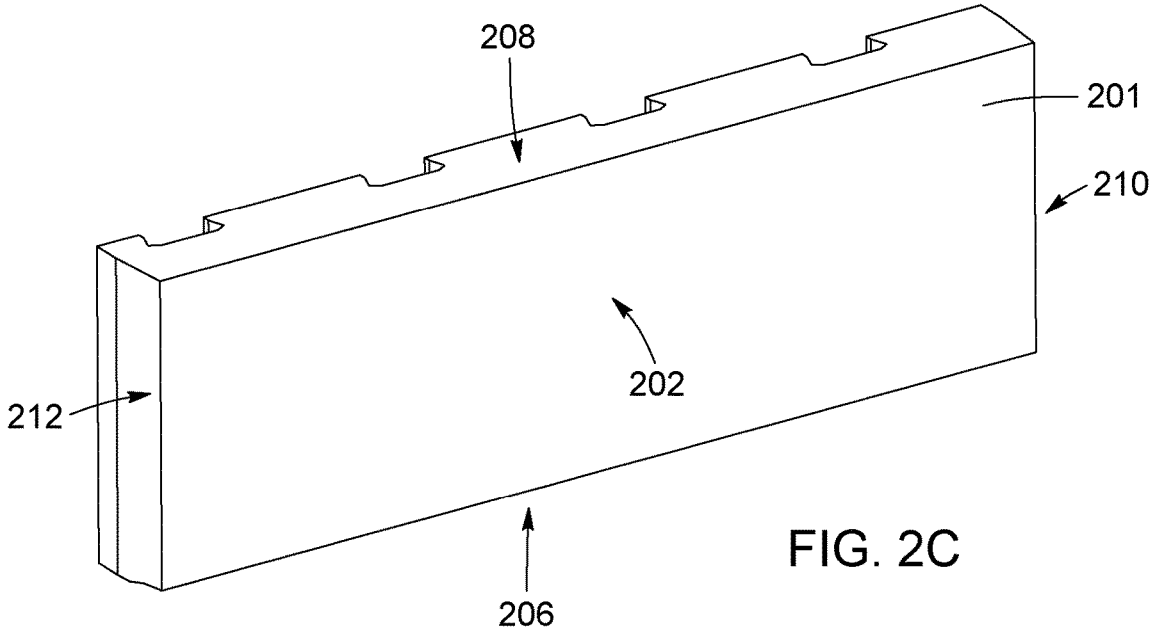
FIGS. 2C and 2D are respective front and rear perspective view of a bottom face of the panel of FIG. 2A.
Figure 2D:
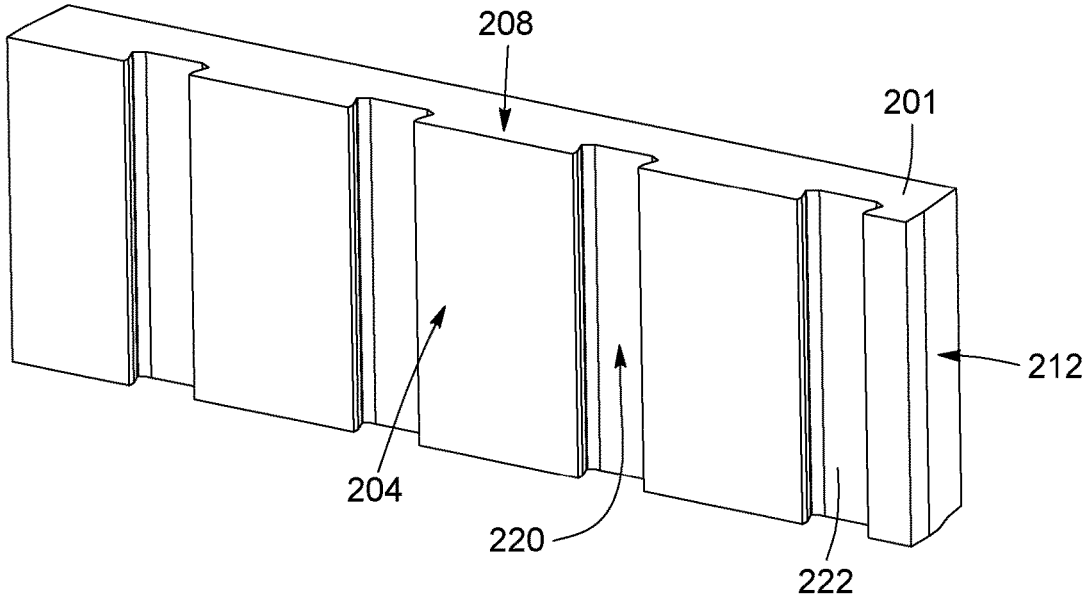
Figure 2E:
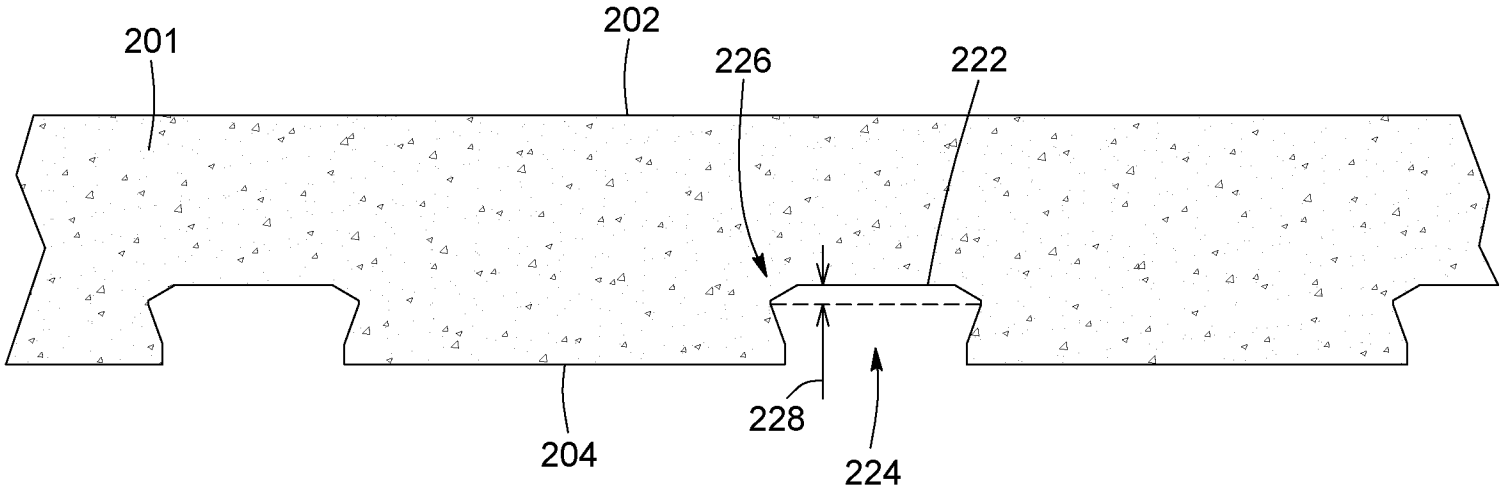
FIG. 2E is a cross section view of the panel of FIG. 2A taken along line 2E-2E, showing the dovetail-shaped notches in the body of the panel.

As best shown on FIGS. 2B and 2D, drainage channels 220 are formed on the rear face 204 of the panels 200. The channels 220 extend along a height 215 of the panel 200, allowing water to drain from the top face 206 down to the bottom face 208. In the present embodiment, the channels 220 are troughs moulded in the panel body 201; they have an interior wall or surface 222 and open along the rear face 204 and on the top and bottom faces 206, 208. As can be appreciated, in this configuration, the panels 200 can be made using a single cast or mould with the channels 220 formed directly therein. Preferably, no additional materials or components are required to form the channels, making the panels 200 simple to manufacture. However, it is appreciated that in alternate embodiments, the channels 220 can be closed on the rear face 204, for example by providing a material to cover the rear face 204, or by moulding the panel bodies 201 such that the rear face 204 is closed.

Preferably, the channels 220 are sized and shaped to engage with the anchors 300. In the present embodiment, and as best viewed in the cross section of FIG. 2E, the channels 220 are tapered notches or grooves 224 which are substantially dovetail-shaped. The notches 224 have a tab-receiving portion 226, for receiving and securing a portion of an anchor 300. In the present embodiment, the tab-receiving portion 226 comprises a slot and corresponds to a widest portion of the notch 224. As such, when a complementary shaped portion of an anchor 300 is inserted in the tab-receiving portion 226, the panel 200 will interlock with the anchor 300. In the present embodiment, the notches 224 are further provided with a liquid or water channeling portion 228 which extends past the tab-receiving portion 226. As can be appreciated, in this configuration, when a portion of an anchor 300 is inserted in the tab-receiving portion 226, the water channeling portion 228 will remain unobstructed, allowing water to drain therethrough along the interior surface 222 of the channel 220.

Referring to FIGS. 2A-2E, preferably, the channels 220 are spaced evenly across a width 214 of the panel 200. Protrusions bumps and or recesses may be provided along the side and top/bottom faces of the panel body 201, for example between and/or adjacent channels 220 in the top 206 or bottom 208 faces, and/or along the side faces of the panels 210, 212. In the present embodiment, the panel 200 comprises protrusions 216 formed on its top face 206, positioned adjacent the channels 220 and proximate to the front face 202. Preferably, the protrusions 216 are formed as part of the body 201. As will be described later on, these protrusions can help with draining water more effectively.

Figures 3A, 3B:
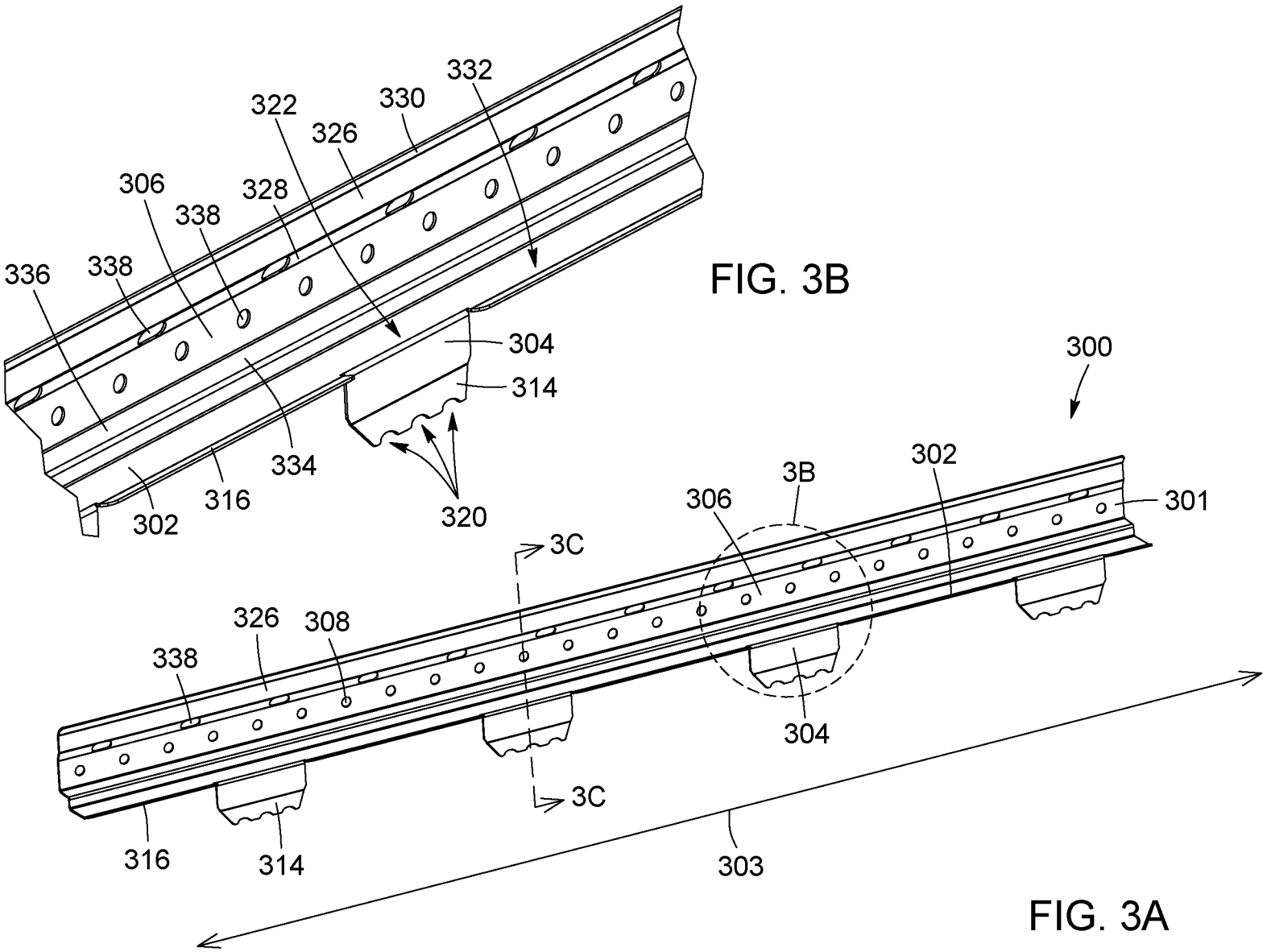
FIG. 3A is a perspective view of an anchor according to an embodiment.
FIG. 3B is a detail view of a segment of the anchor of FIG. 3A.
Figure 3C:
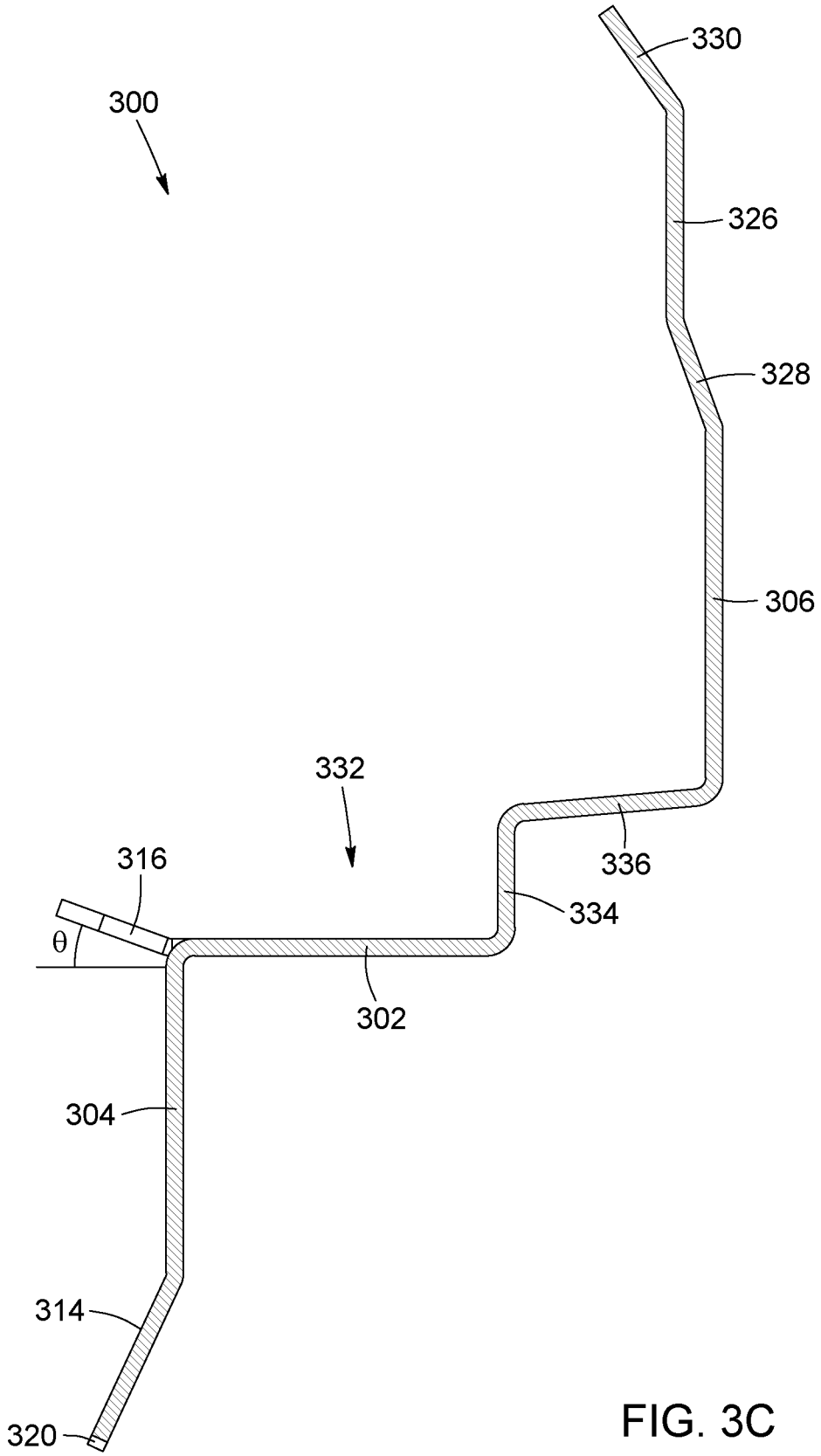
FIG. 3C is a cross section view of the anchor of FIG. 3A taken along line 3C-3C.

With reference now to FIGS. 3A to 3C, but also still to FIGS. 2A to 2E, an anchor 300 is shown according to an embodiment. Generally speaking, the anchor 300 can serve to both secure panels to a supporting wall and aid in water management. In the present embodiment, the anchor 300 has a substantially elongated body 301 extending along a length 303, preferably corresponding to a width 214 of the panel 200 with which it will engage. The body 301 is preferably made from a rigid resilient, and/or flexible material, such as metal or plastic for example, but preferably metal. Preferably still, the body 301 is made of a corrosion resistant material. In the present embodiment, anchor 300 is configured to engage with at least a top of a panel 200, and secure or anchor the panel 200 to a supporting wall. The body 301 is therefore complementary in shape with a top portion of the panel 200. More particularly, the body comprises a panel abutting portion 302 extending in a horizontal plane, for abutting against the top face 206 of the panel 200. The body 301 further includes a wall engagement mechanism for securing the anchor 300 to a supporting wall, and a panel engagement mechanism for engaging with the panel 200. In the present embodiment, the wall engagement mechanism comprises a mounting plate 306 which can be secured to the supporting wall via fasteners, such as screws. The panel engagement mechanism comprises tabs 304 configured to insert into channels 220 of a panel 200. The tabs 304 extend from the panel abutting portion 302, substantially perpendicularly thereto, in a vertical plane. As can be appreciated, by engaging anchor 300 with the panel 200 in this fashion, the anchor 300 can prevent a push-in and a pull-out of a top portion of the panel 200 relative to the supporting wall. It is appreciated, however, that other types of panel engagement mechanisms are also possible.

The tabs 304 are portions of the anchor 300 which are sized and shaped to be received in and secured by the channels 220 of a panel 200. In the present embodiment, the tabs 304 are flat projections which can be slid into the tab-receiving portion 226 of a channel 220. Although in the present embodiment the tabs 304 are flat projections, it should be appreciated that in other embodiments the tabs 304 can take any other shape or form as long as they can be secured in the channels 220. For example, the tabs 304 can have a contour which is complementary to that of the tapered notch 224 which forms the channels 220. Preferably, the anchor is provided with deflectors for directing water received along a top face 206 of the panel 200 towards the interior surface 222 of the channel, so that it can be directed away from the supporting wall while the water drains through the channel 220. As can be appreciated, in this configuration, water can drain through a drainage plane located between the supporting wall and the front face 202 of the panel 200, and more particularly parallel to the supporting wall and inside the body 201 of the panel 200, rather than along the exterior of the body 201 and rather than along the supporting wall. In the present embodiment, the tabs 304 act as deflectors, and comprise an angled portion 314 provided in a distal end thereof. The angled portion 314 is angled away from the mounting plate 306, such that when the tab 304 is inserted into a channel 220, the angled portion 314 extends in the water channeling portion 228 of the channel 220 and towards the interior surface 222 of the channel 220. Preferably, the distal end of the tabs 304 is in close proximity to, or even in contact with, the interior surface 222 of the channel 220. As a result, water flowing over the tab 304 is directed towards the interior surface of the channel 222 and thus away from a supporting wall to which the anchor 300 is secured. The tab 304 and the channel 220 effectively act as a funnel, directing draining water to a specific area, preferably away from the supporting wall, thereby protecting the supporting wall from water damage. The angled portion 314 can be configured to break up water droplets flowing over the distal end of the tab 304, and prevent saturation of the funnel, for example to encourage a laminar flow of water through the funnel, particularly when the angled portion 314 is in contact with the interior surface 222 of the channel 220. For example, in the present embodiment, apertures are in the distal end of the tab 304, forming teeth or notches 320. Others means to prevent saturation of the funnel are also possible. For example, the tab 304 can have a non-uniform profile (i.e. it can be undulated instead of having a flat profile), and/or apertures can be provided at any location along the tabs 304.

The mounting plate 306 preferably extends from a top side of the panel abutting portion 302, in a direction opposite that of the tabs 304, making it easier to secure to a supporting wall. In other configuration, however, the mounting plate 306 can extend in the same direction as the tabs 304. The mounting plate 306 is provided with screw holes 308 for receiving screws therein and securing the anchor 300 to a supporting wall. It should be appreciated that although in the present configuration the anchor 300 is secured with screws, other fasteners or securing means are also possible and the configuration of the mounting plate can change to accommodate said other securing means. Preferably, the mounting plate 306 is spaced apart from the tabs 304 such that when the mounting plate 306 is secured to a supporting wall, the panel 200 engaged with the anchor 300 is not directly in contact with the supporting wall and is preferably spaced apart therefrom by several millimetres. In the present embodiment, the panel is spaced away from the supporting wall via a wall spacing element 336. As can be appreciated, this allows air to flow behind the panels 200 in a continuous air gap between the supporting wall and the rear faces 204 of the panels 200. As will be explained in more detail hereinafter, this can allow for the equalization of pressure between the front and rear sides of the panels 200. It also allows for water draining through the channels 220 in the panel 200 to be kept away from the supporting wall. Advantageously, in the present configuration, the channels 220 cause water to drain inside the body 201 of the panel 200, further distancing the draining water from the supporting wall.

As described above, the anchor 300 can engage with a panel 200 such that the tabs 304 prevent a push-in and a pull-out of a top portion (i.e. a portion proximate to the top face 206) of that panel 200 relative to the supporting wall. However, the anchor 300 can also be configured to support and/or engage with a top-adjacent panel 200, for example to prevent a push-in and a pull-out of a bottom portion (i.e. a portion proximate to the bottom face 208) of the top-adjacent panel 200. In the present embodiment, the anchor 300 comprises a track 326, a push-in abutment 334 and an extension portion 316 for supporting a top-adjacent panel 200. It is appreciated, however, that other adjacent panel securing mechanisms can also be provided.

In more detail now, and as best shown in FIGS. 3B and 3C, track 326 is provided to engage with a bottom portion of a top-adjacent panel 200, to prevent a pull-out thereof, and to allow the top-adjacent panel 200 to slide freely along anchor 300. In the present embodiment, track 326 comprises a substantially flat section of the anchor body 301 extending from the mounting plate 306, and running continuously along the length 303 of body 301. However, it is appreciated that other configurations of the track are also possible. Preferably, track 326 is spaced apart from the mounting plate 306 and thus the supporting wall via a spacing element 328. In the present embodiment, the spacing element 328 comprises a section of the anchor body 301 extending between the mounting plate 306 and the track 326, and angled away from the mounting plate and the supporting wall. In this configuration, when anchor 300 is secured to a supporting wall, a space is defined between a rear side of the track 326 and the supporting wall. As will be described in more detail hereinafter, this space can receive a portion of a corresponding bracket which can abut against the rear side of the track 326. Moreover, the spacing element 328 can be provided with drainage holes 338 (for example in the form of oblong apertures, as in the illustrated embodiment), so that water in the plane of the supporting wall can drain onto a top side of the anchor 300, and can thus be managed as will be described in more detail hereinafter. In the present embodiment, an angled section 330 is provided at a distal end of the track 326. The angled section 330 is angled away from the track 326, mounting plate 306, and supporting wall, and as will be described in more detail herein below, can serve to facilitate engagement with a bracket.

The push-in abutment 334 is provided to abut against the rear face 204 of a bottom portion of the top-adjacent panel 200 to prevent a push-in thereof. In the present embodiment, the wall spacing element 336 of the anchor body 301 is vertically offset (i.e. stepped-up) relative the panel abutment portion 302. This vertical offset forms a vertical wall which defines the push-in abutment 334. When assembled, the bottom portion of the top-adjacent panel 200 abuts against this vertical wall, keeping the bottom portion of the top-adjacent panel 200 spaced apart from the supporting wall by a distance corresponding to a length of the wall spacing element 336. In the present embodiment, the push-in abutment 334 extends from a rear the panel abutment portion 302, and is spaced apart from the tabs 304 such that when the anchor 300 is engaged with the panel, the push-in abutment 334 extends in the same plane as the rear face 204 of the panel. In this configuration, the push-in abutment 334 maintains the rear faces 204 of the panel and the top-adjacent panel in a common plane, for example in a plane parallel to the supporting wall, thereby assuring alignment of both panels. Other configurations are possible, however. For example, push-in abutment 334 can extend frontward or rearward relative to the plane of the rear face 204 of the panel 200, for example to slant the panels 200 relative to the supporting wall.

Figure 1D:
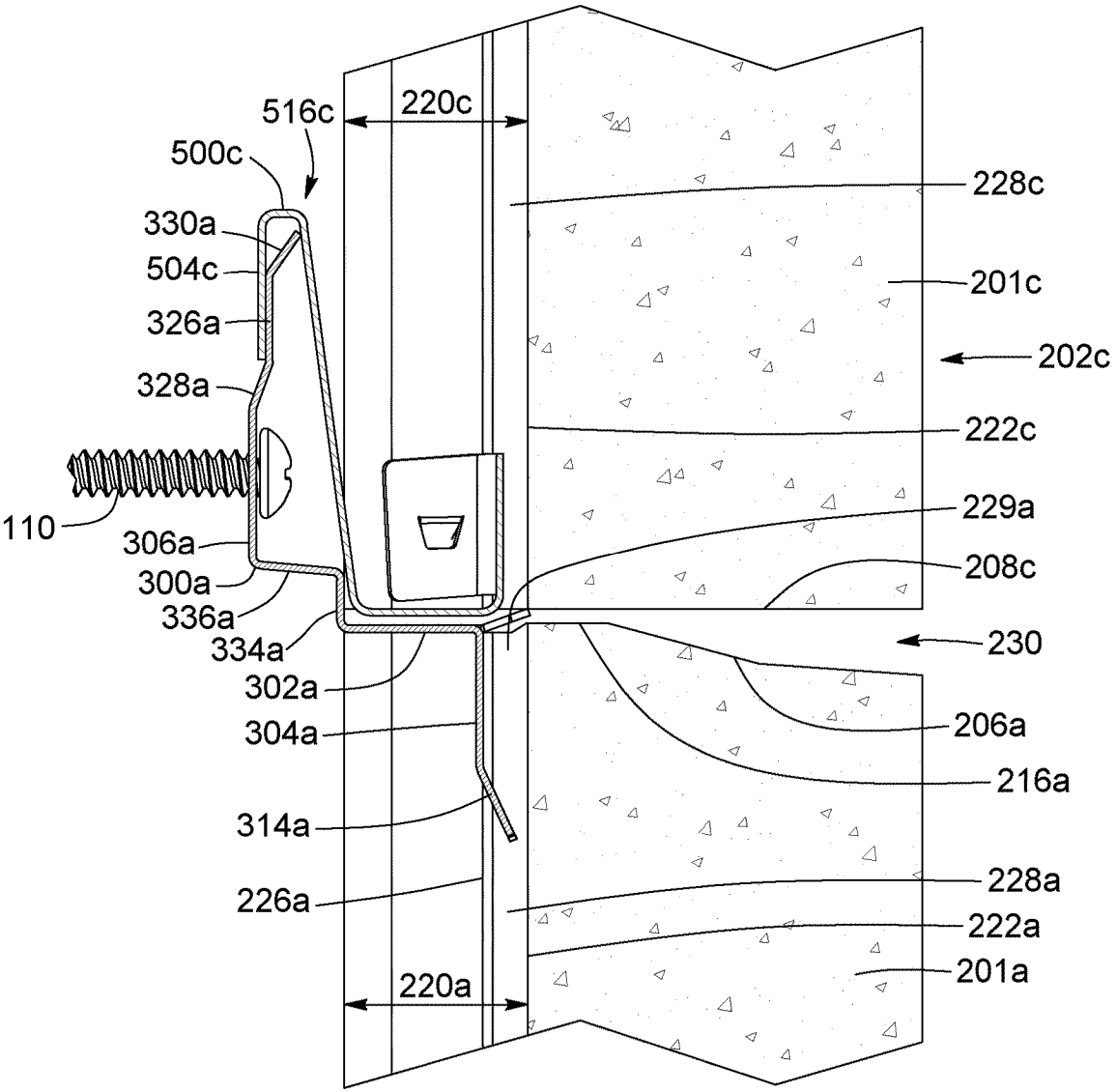
FIG. 1D is a detail view of a cross section of FIG. 1C taken along line 1D-1D showing a tab of an anchor engaging with the water drainage channels of a panel, and a bracket of a top-adjacent panel engaging with the track portion of the anchor.
Figure 1E:
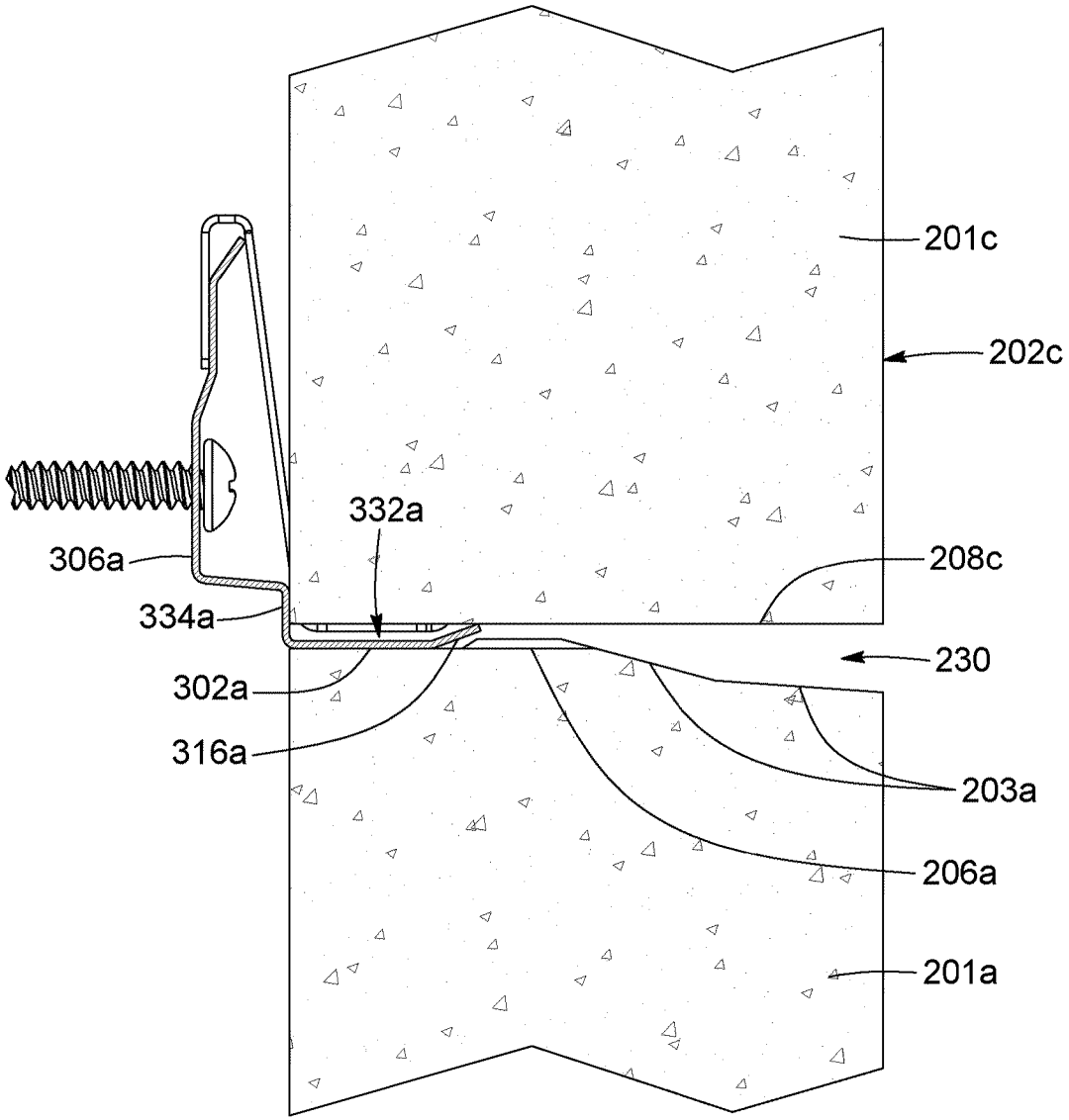
FIG. 1E is a detail view of a cross section of FIG. 1C taken along line 1E-1E showing the elevated wings of the anchor abutting the bottom face of a top-adjacent panel.

Extension 316 is a portion of the anchor 300 body extending from a top side of the panel abutting portion 302. In the present embodiment, the extension comprises elevated wings 316 extending from a front section of the anchor. As illustrated in FIG. 1E, the elevated wings 316 are configured to abut against the bottom face 208 of the top adjacent panel. In this configuration, elevated wings 316 can provide vertical support to the top adjacent panel 200, and can act as panel spacing element for spacing apart the bottom face 208 of the top adjacent panel, and the top face 206 of the panel 200 with which the anchor 300 is engaged. Preferably, wings 316 extend at an angle θ of between 10° and 70° relative to the panel abutting portion 302, and preferably still at approximately 30°, as in the present embodiment. In this fashion, wings 316 can act as a spring to absorb stresses generated by movements in the wall plane, for example due to heat variations causing expansion or contraction of components. As can be appreciated, wings 316 can also aid in water management. More particularly, wings 316 close a space between the abutting portion 302 and the bottom face 208 of the top-adjacent panel 200 (i.e. along the horizontal joint), preventing water from entering therethrough. In a similar fashion, wings 316 help in confining water on the panel abutting portion 302 in a gutter 332 defined between the wings 316 and the push-in abutment 334. In the present embodiment, the gutter 332 extends along the top face of the panel and has a substantially U-shaped profile defined by the wings 316 and push-in abutment 334. Water received on the top side of the anchor 300 can thus flow along gutter 332. Preferably, the anchor 300 has apertures formed therein to allow water flowing there along to be channeled through the drainage channels 220 of the panel 200 with which it is engaged. In the present embodiment, gutter 332 has apertures 322 comprising breaks in the wings 316 aligned with the tabs 304, and thus aligned with the drainage channels 220 of the panel 200 with which the anchor is engaged. Water received in gutter 332 can thus be channelled to a nearest drainage channel 220 of the panel 200 to be drained.

In the illustrated embodiment, the anchor 300 engages with panel 200 on its top face 206, preventing pull-out and push-in movement of the panel 200 along its top edge (i.e. the top edge of the panel cannot move toward or away from the supporting wall because the anchor tabs 304 are engaged in the channels 220) as well as lateral movement of the panel (i.e. tabs 304 further prevent the panel 200 from sliding along the length of the anchor 300). The anchor 300 also engages with a top-adjacent panel 200 on its bottom face 208, thus preventing pull-out and push-in movement of the bottom edge of the panel 200. Since the anchor 300 is removably engaged with panel 200 (i.e. it can slide vertically in and out of the channel 220), the anchor 300 does not necessarily secure the panel 200 along a vertical axis. In the present embodiment, panel 200 is instead supported vertically by engaging with an anchor 300 of a bottom adjacent panel. If there is no panel below, (i.e. if panel 200 is a bottommost panel) a starter anchor 400 can be provided in order to vertically support panel 200. The starter anchor 400 can serve to support a first row of panels, while second and subsequent rows of panels can be supported by abutting against the row below and/or by engaging with the anchors of the row below.

Figure 4B:
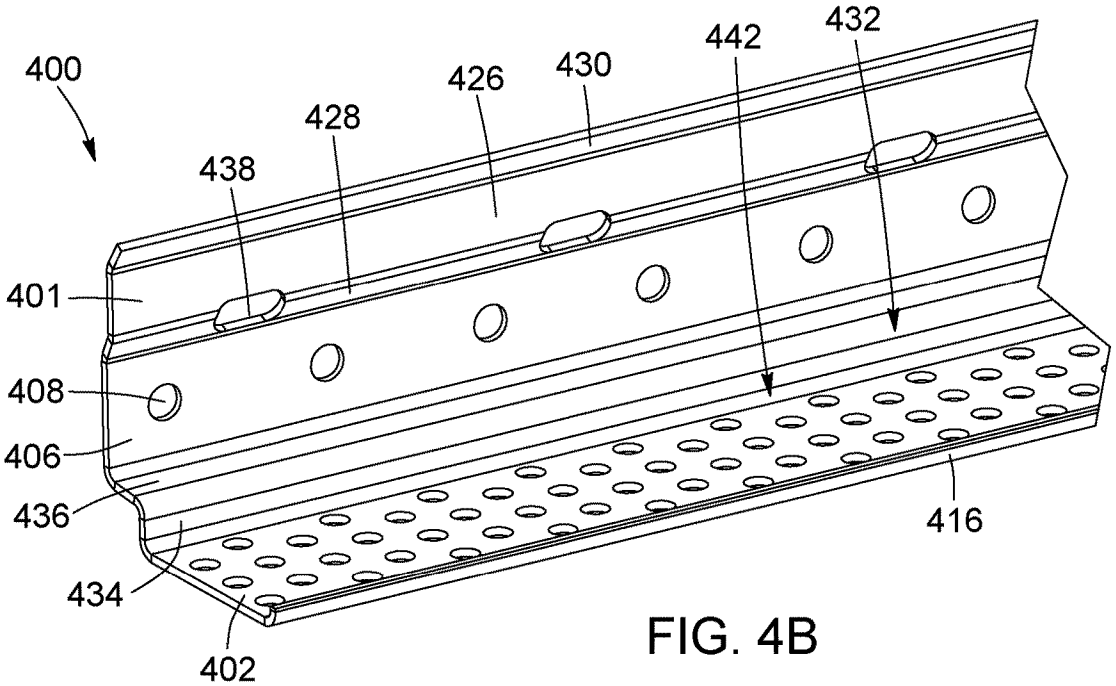
FIG. 4B is a detail view of an end of the starter anchor of FIG. 4.
Figure 4A:
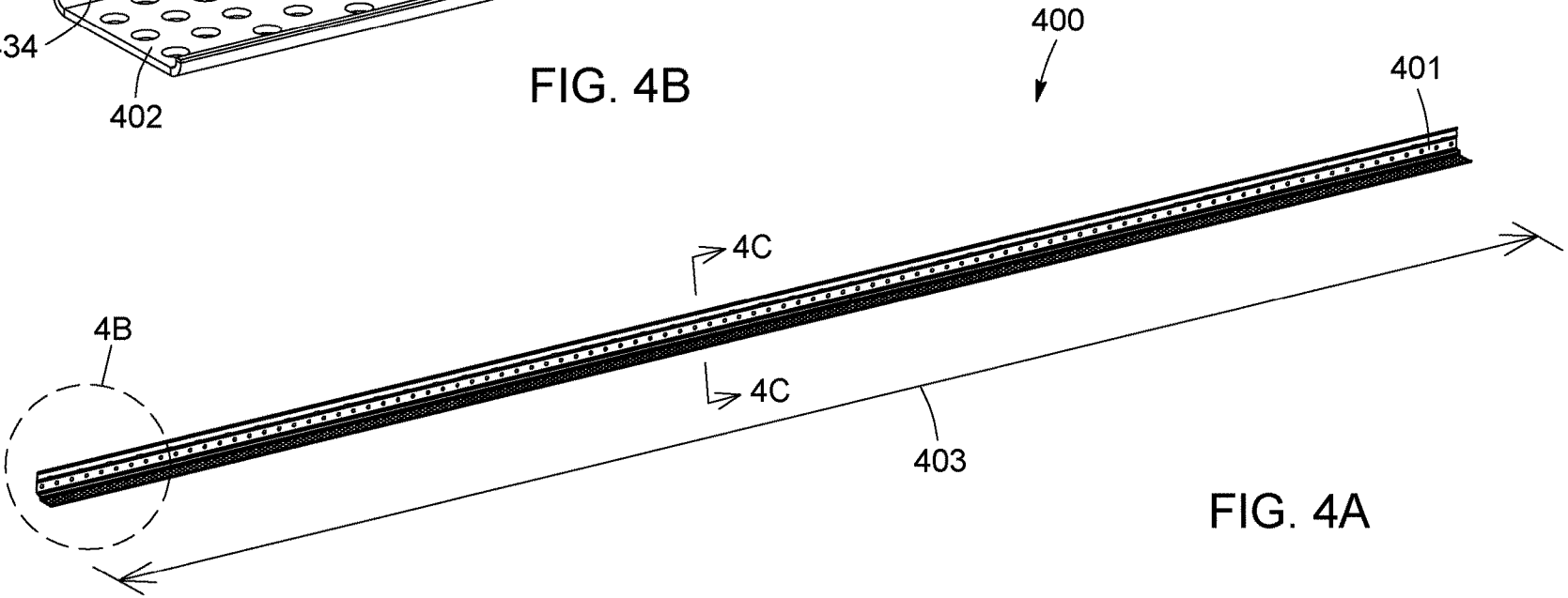
FIG. 4A is a perspective view of a starter anchor according to an embodiment.
Figure 4C:
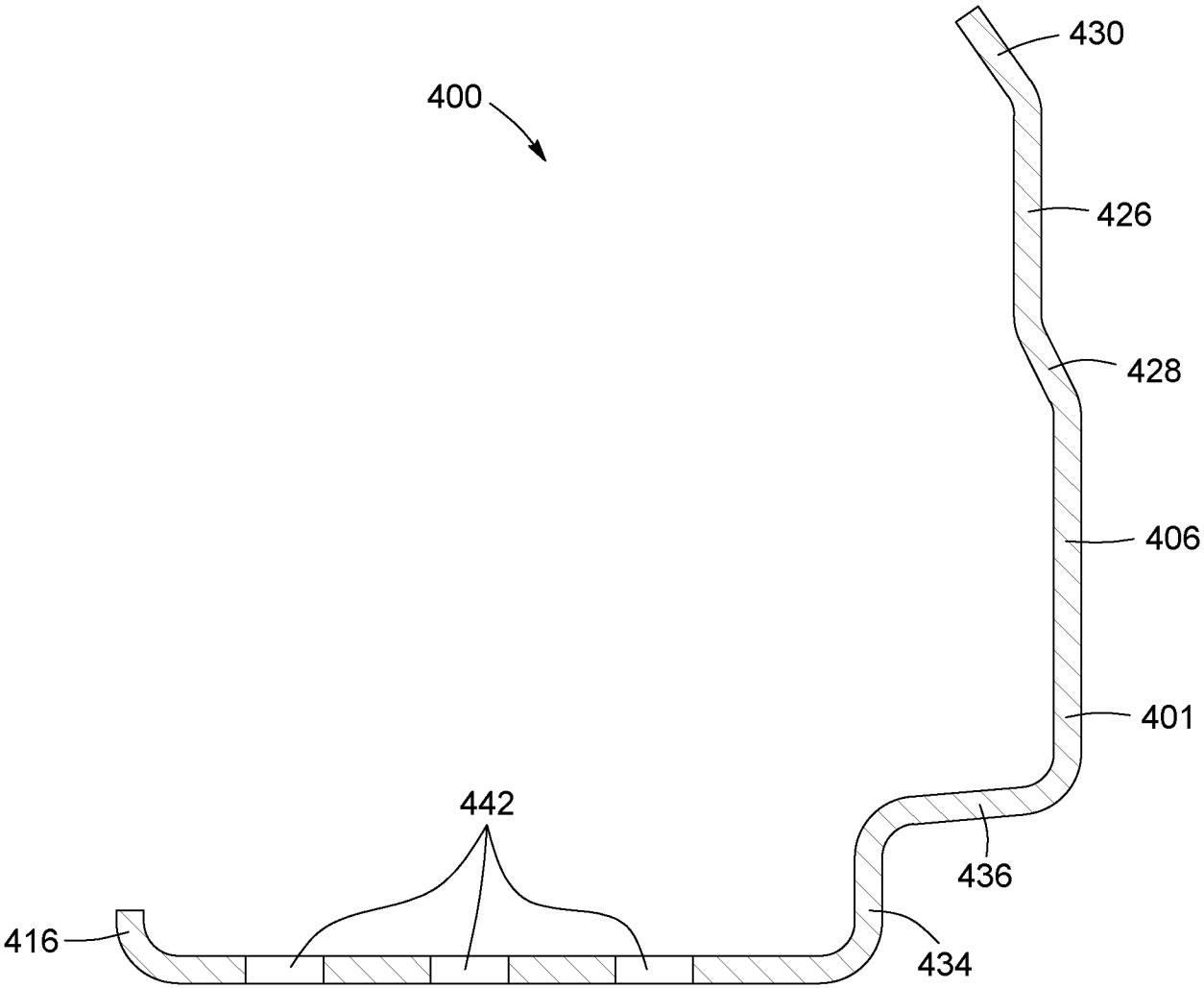
FIG. 4C is a cross section view of the anchor of FIG. 4A taken along line 4C-4C.

With reference now to FIGS. 4A to 4C, a starter anchor 400 is shown according to an embodiment. In the present embodiment, the starter anchor 400 is configured very similarly to anchor 300 described above in that it comprises similar elements for interfacing with a top-adjacent panel and is made from the same materials. For clarity, elements common to anchor 300 and starter anchor 400 are denoted by similar reference numbers (i.e. references in the 300s series correspond to those in the 400s series).

More particularly, starter anchor 400 has an elongated body 401 extending along a length 403. Preferably, length 403 of starter anchor 400 is longer than that of anchor 300. For example, anchor 400 can have a length 403 corresponding to a length of a plurality of panels. The body 401 includes a mounting plate 406 with screw holes 408 for securing the anchor 400 to a supporting wall. The body 401 further includes a track 426 with an angled portion 430 in a distal end thereof.

Track 416 is spaced from plate 406 via spacing element 428 with drainage holes 438 formed therein. The body 401 also includes a push-in abutment 434 spaced apart from mounting plate 406 via spacing element 436. Finally, the body 401 includes a base portion 402 (corresponding to panel abutment portion 302) extending perpendicularly relative to mounting plate 406. Elevated wings 416 are provided at a front end of the base portion 402, which defines gutter 432 and which abut the bottom face of a panel. In the present embodiment, gutter 432 has drainage holes 442 formed therein, allowing water reaching the gutter to drain out.

Figure 5A:
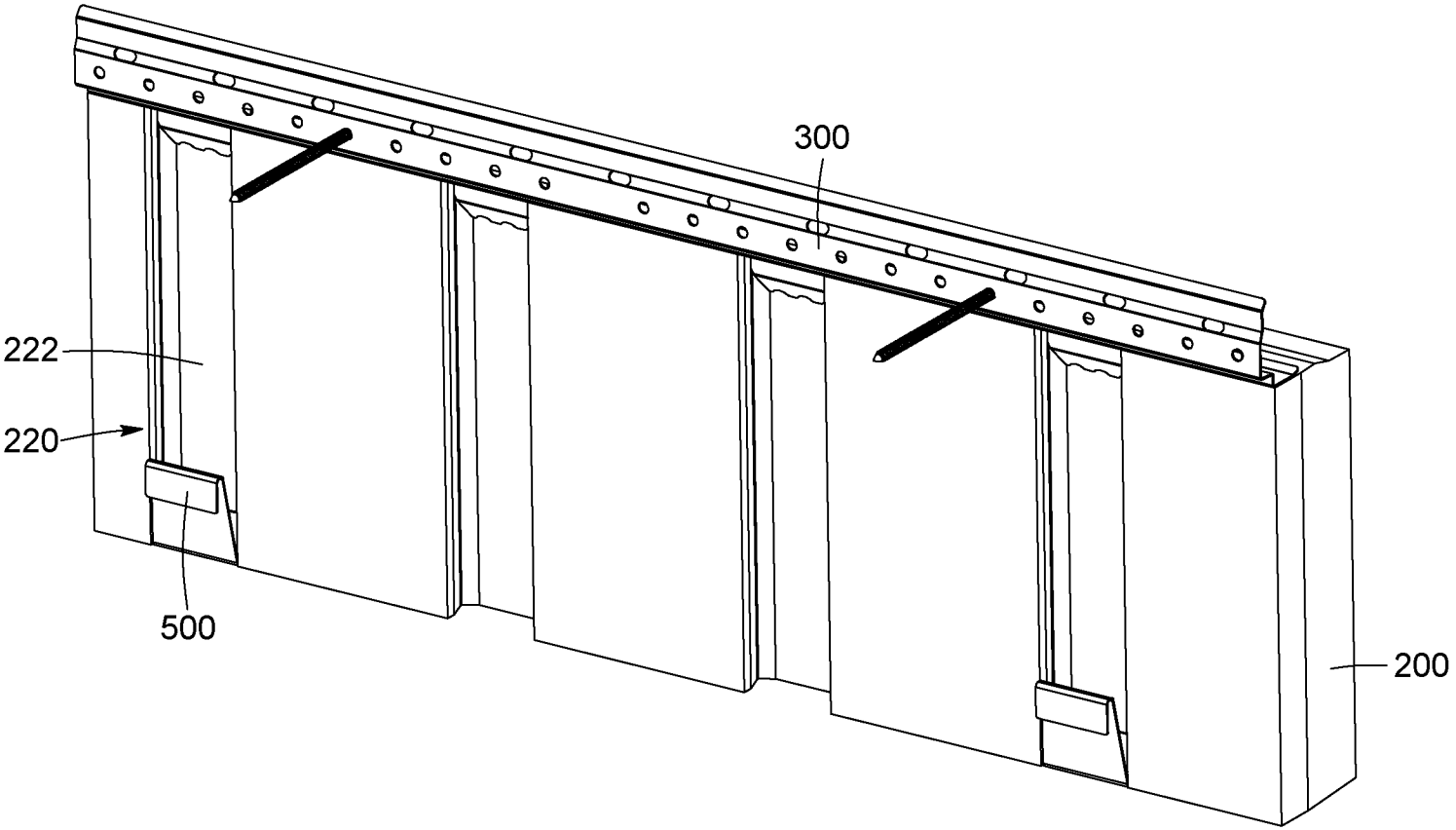
FIG. 5A is a rear perspective view of a panel having brackets engaged in channels thereof, according to an embodiment.
Figure 5B:
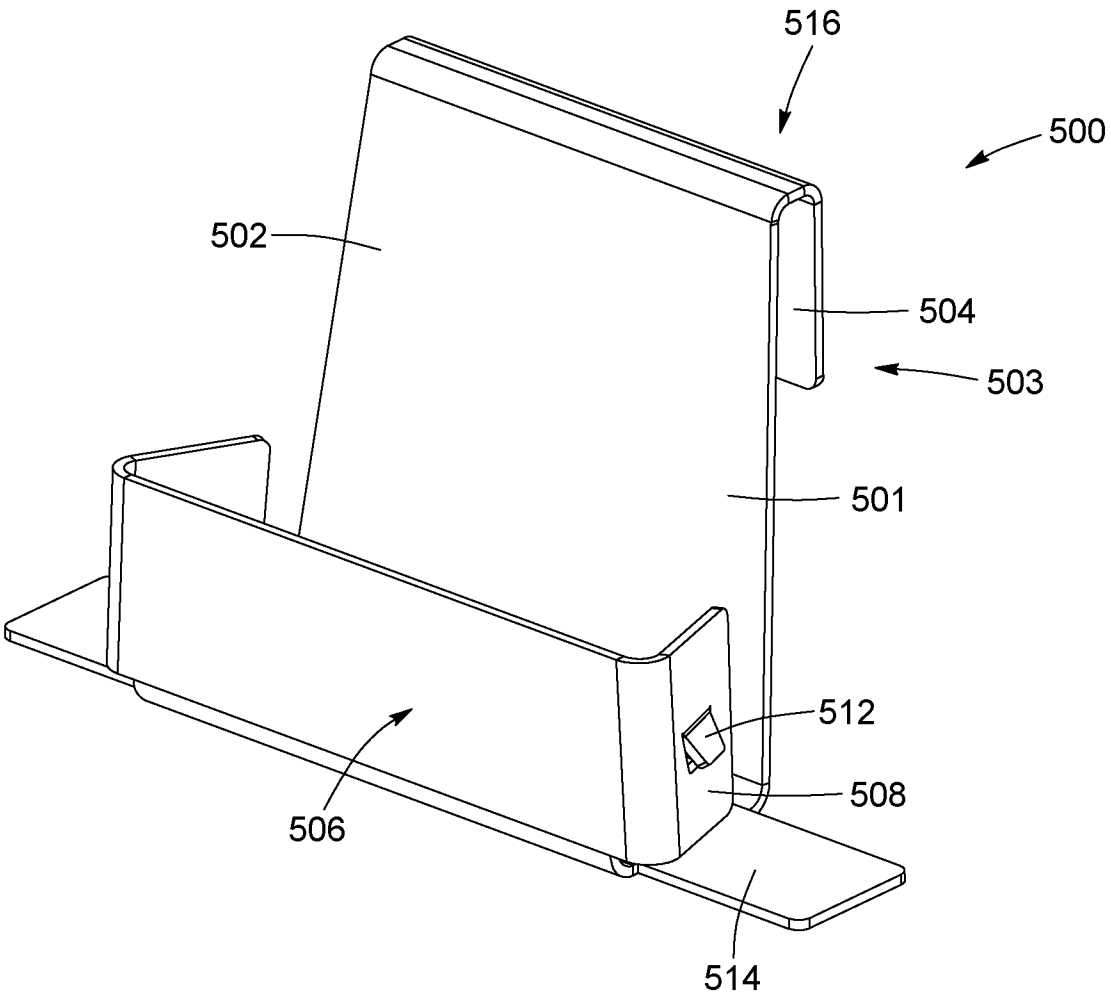
FIG. 5B is an individual view of a bracket of FIG. 5A.

In the present embodiment, anchors 300, 400 engage with bottom portions of top-adjacent panels via brackets. With reference to FIGS. 5A and 5B, a bracket 500 is shown according to an embodiment. Bracket 500 is provided in a bottom portion of panel 200 for engaging with track portion of anchors 300, 400. Bracket 500 can also be referred to as a slider, in that it is preferably slidably engages with track portions of anchors 300, 400, and thus allows panel 200 to slide along anchors 300, 400 when engaged therewith via the bracket 500. The illustrated bracket 500 is engageable with the channels 220 of a panel 200, preferably on the bottom face 208 thereof. When engaged with the channels 220, bracket 500 can prevent a pull-out of the panel 200. For example, in the present embodiment bracket 500 is provided in a bottom portion of the panel 200. The bracket 500 can thus prevent a pull-out of a bottom edge of the panel 200 when engaged with anchors 300, 400.

In the illustrated embodiment, the bracket 500 comprises a body 501 with a track engagement portion 503 and a panel engagement portion 506. The panel engagement portion 506 is secured in the channel 220 of a panel, and can comprise dovetail-engaging wings 508 for engaging with the dovetail-shaped contour of the channel 220. Panel engagement portion 506 can further comprise press-fit elements 512 for press-fitting in the channel 220, and a panel abutment portion 514 for abutting a bottom edge 208 of the panel 200. Although in the present embodiment the brackets 500 are removably engageable with the panel 200, it should be understood that in alternate embodiments, the brackets can be permanently engage in the panel and/or can be embedded in the body 201 of the panel 200. Preferably, each panel 200 is provided with two sliders 500 which are spaced apart. In the illustrated embodiment, the sliders 500 are positioned in the outermost channels 220, i.e. adjacent the left and right faces 210, 212 of the panel 200.

Figure 1F:
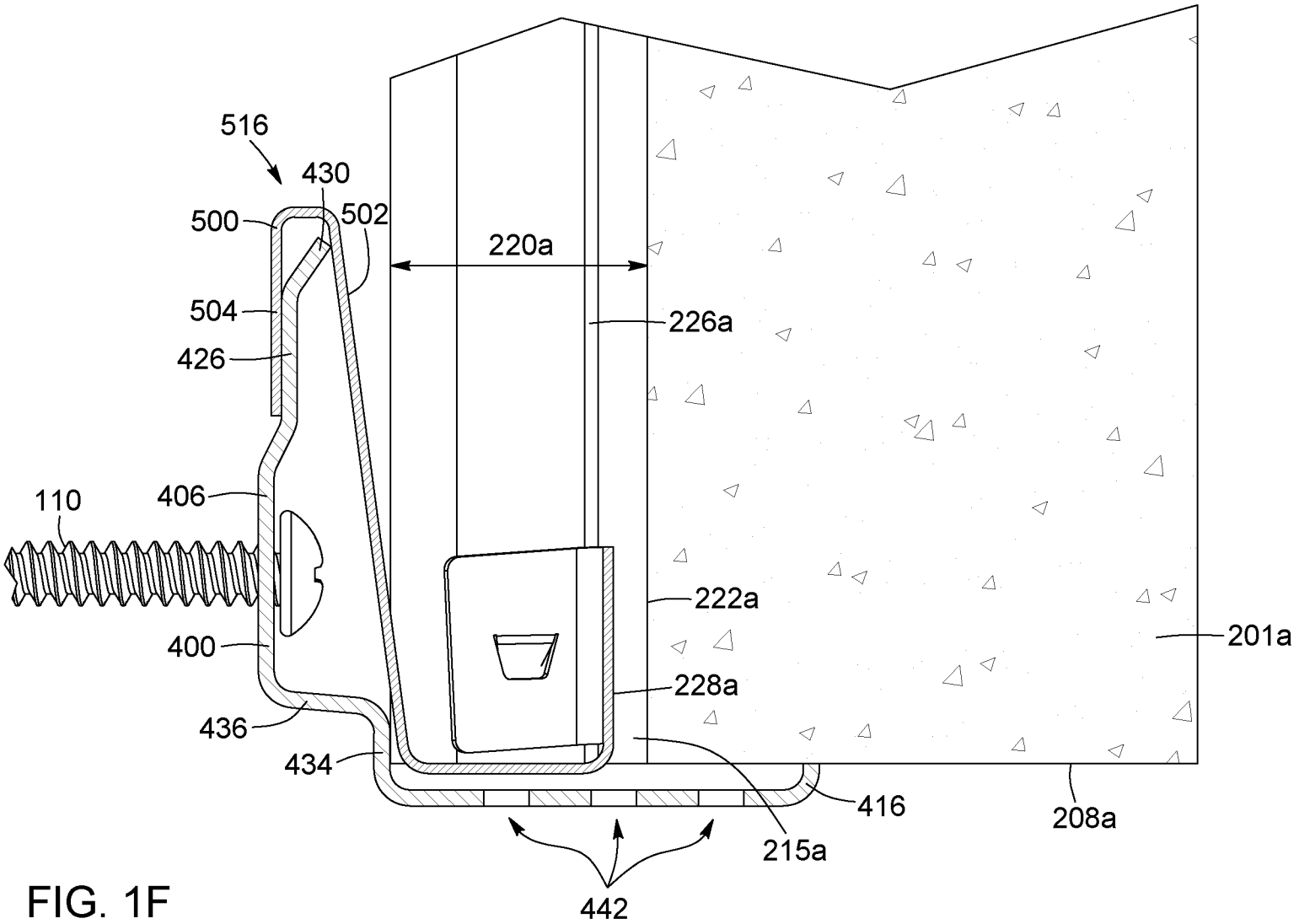
FIG. 1F is a detail view of a cross section of FIG. 1C taken along line 1F-1F showing a bracket of a panel engaging with the track portion of a starter anchor.
Figure 6A:
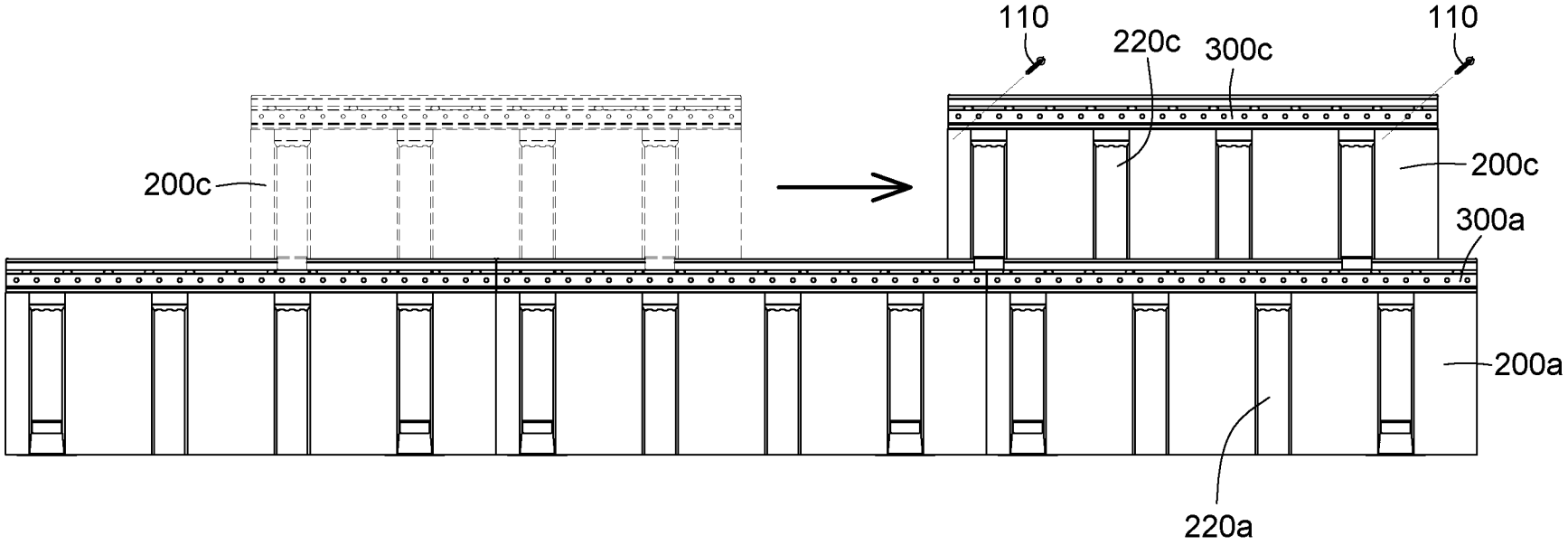
FIG. 6A is rear view of a plurality of panels, schematically illustrating assembly of a veneer using an embodiment of the cladding system.

With further reference to FIG. 1F, panel engagement portion 506 is configured to engage with track 426 via a U-shaped element 516. The U-shaped element 516 fits overs track 426, and a track-abutment portion 504 of the U-shaped element 514 abuts against the track 426. In other words, bracket 500 effectively hangs from the track 426. In this configuration, track-abutment portion 504 is secured behind the track 426, preventing a pull-out movement of bracket 500, and thus the panel 200 with which it is engaged. In the present embodiment, a distal end of the track 426 comprises an angled portion 430 for facilitating engagement with the U-shaped element 516. Moreover, track engagement portion 503 is spaced apart from panel engagement portion 506, such that when bracket 500 is engaged with track 426, panel 200 can be spaced apart from the supporting wall. Preferably, surfaces of the track 426 and track abutment section 504 are smooth, allowing bracket 500 to slide freely along the track 426. As can be appreciated, this can simplify installation of panels, as panel 200 can be supported by an anchor 400 below while it can be slid laterally into position for installation, as illustrated in FIG. 6A. Although bracket 500 was described in cooperation with starter anchor 400, it is appreciated that the same applies to anchor 300.

As shown in FIGS. 1A to 1F, when multiple panels 200*a*, 200*b*, 200*c* are assembled, they are stacked one on top of the other, preferably in a staggered fashion. Although in the present embodiment the staggering is achieved by offsetting adjacent layers by approximately half the width of a panel 214, the offset amount can vary depending on the desired finish or pattern of the panels. As can be appreciated, in the stacked configuration, the bottom edge 208*c* of a panel 200*c* abuts against the anchor 300*a* resting on the top edge 206*a* of a panel below (in the present embodiment against wing 316*a* of anchor 300*a*), thus keeping the top panel 200*c* in place. In alternate embodiments, however, the panels and the anchors can be sized so that the top and bottom edges of stacked panels abut directly. Preferably, spacing is provided between laterally adjacent panels. This spacing can allow air to flow between the front and rear sides 202, 204 of the panels, and can also allow water to drain between panels so that it can be delivered to an anchor 300 of a bottom-adjacent panel, and managed for subsequent drainage through channels 220. In other words, the vertical joints between side-adjacent panels can act as drainage channels to the 300 anchor. In some embodiments, this spacing can be achieved by providing panel spacing elements along the side edges 210, 212 of the panels, such as protrusions, bumps and/or recesses. As can be appreciated, the stacking configuration described above can be repeated laterally and vertically to form a veneer 11 and completely cover a supporting wall.

Figure 6B:
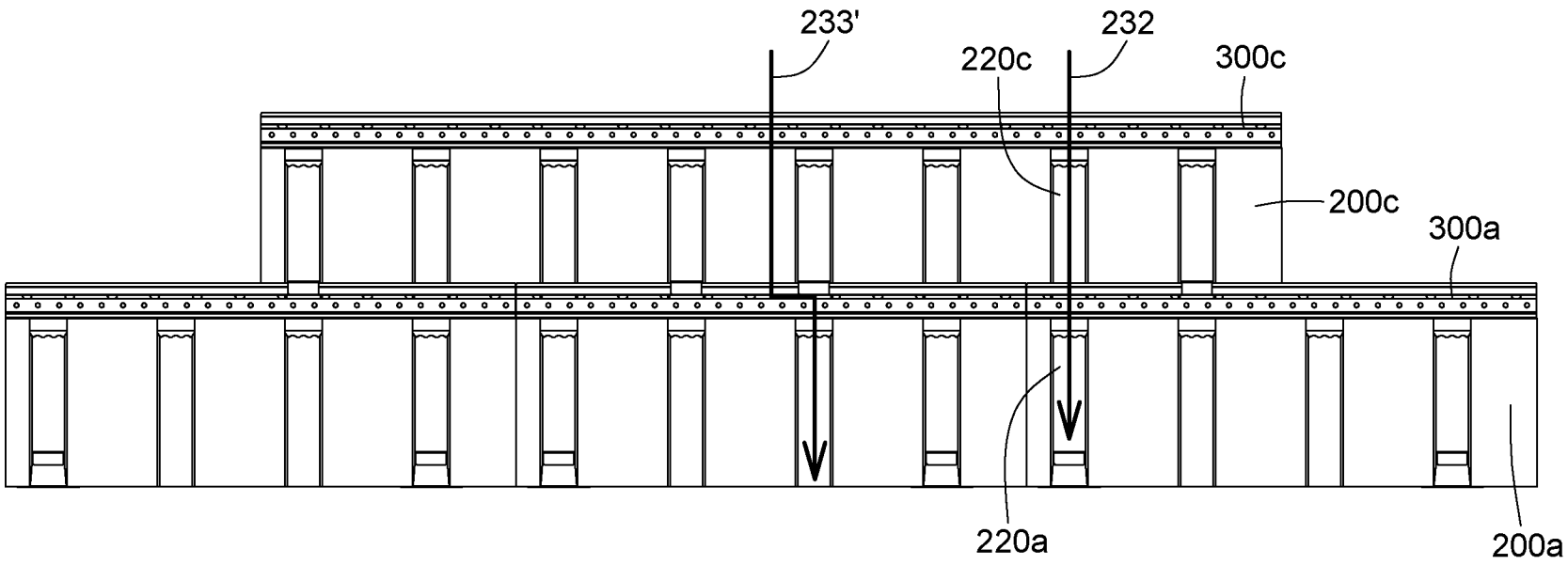
FIG. 6B is a rear view of a plurality of panels showing a path of drained water in an embodiment where the panels are assembled with aligned channels.

Preferably, the channels 220 are arranged such that when panels 200 are vertically stacked, the channels 220 of stacked panels align, thus forming a continuous channel extending from the top surface 206 of the top panel 200 to the bottom edge 208 of the bottom panel 200. As illustrated in FIG. 6B, panel 200*c* is stacked on panel 200*b*. The channels 220*b*, 220*c* of both panels 200*b*, 200*c* align to form a continuous channel between top edge 206*c* and bottom edge 208*b*. As schematically shown by path 232, water can drain in a straight line through aligned channels 220*c* and 220*a*. As can be appreciated, when many panels are stacked vertically on top of one another, the channels of all the stacked panels cooperate to form drainage channels which run vertically along the full height of the veneer 11. In some embodiments, the continuous channel can also be formed via vertical joints between side-adjacent panels. As schematically shown by path 233', water can drain in a vertical joint between side-adjacent panels before reaching a drainage channel 220 of a panel below. In some embodiments, for example as illustrated in FIG. 6C by path 233, the panels can be arranged such that vertical joints of side-adjacent panels are aligned with a channel 220 of a panel below.

It is appreciated that in some embodiments, the channels of vertically stacked panels can be out of alignment when the panels are installed. As described above, the anchors permit a lateral movement of panels stacked thereon. Therefore, as illustrated in FIG. 6A, when installing a panel 200*c*, the panel 200*c* can be slid laterally while stacked on top of a panel 200*a* below until it reaches a desired installation position (for example to achieve a ½ or ⅓ running bond pattern of the panels 200). Once in position, the panel 200*c* can be secured from further lateral movement using screws 110. As can be appreciated, stacked panel 200*c* can be positioned at any lateral location relative to panel 200*a*.

As can be appreciated, anchor 300 is configured to cooperate with the panels 200 such that water arriving anywhere along the top face of the panel 200 is directed towards the drainage channels 220, whether the water arrives from channels of a panel stacked thereon (either in alignment or out of alignment), from other sources such as a window, or from vertical joints between two side-adjacent panels. More particularly, as described above, the gutter portion of anchor 300 allows water received anywhere along the top face 206 of the panel 200 with which it is engaged to be directed to a nearest drainage channel 220 of that panel 200. Similarly, water arriving along the top edge 206 which originates from a front side 202 of the panel 200 or from a rear side 204 of the panel will also be directed towards the drainage channels 220.

Figure 6C:
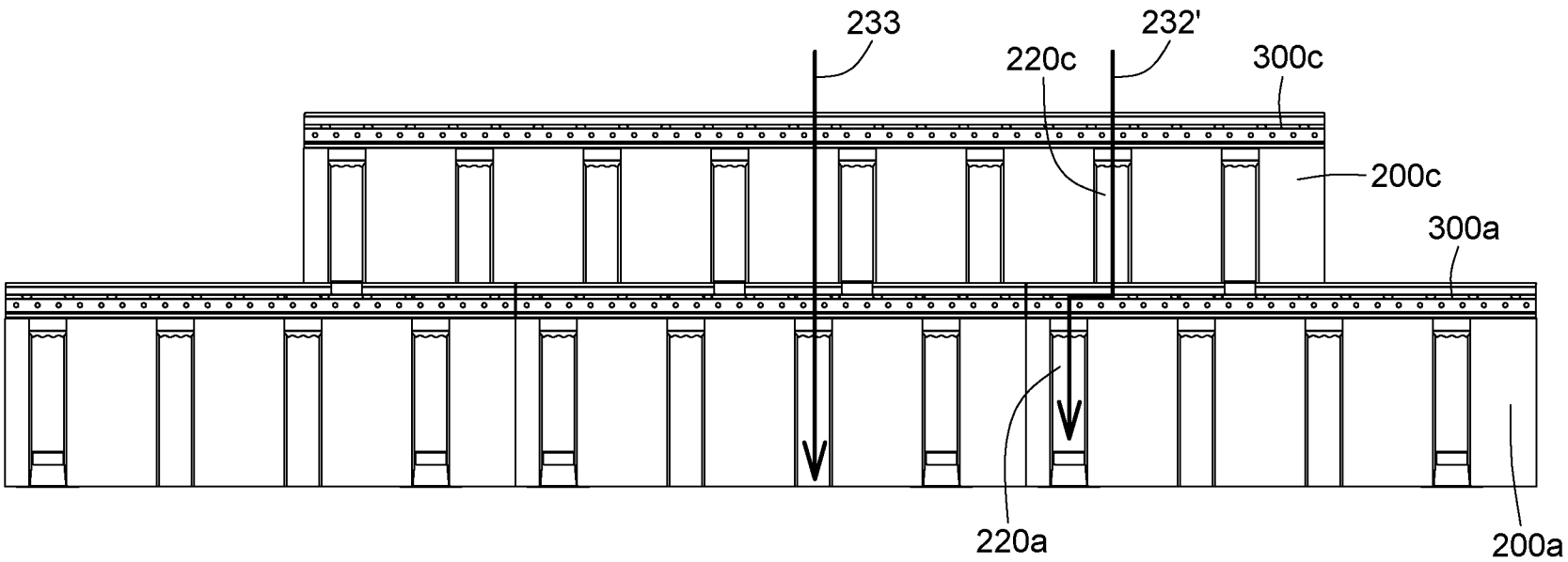
FIG. 6C is a rear view of a plurality of panels showing a path of drained water in an embodiment where the panels are assembled with channels out of alignment.
Figure 7A:
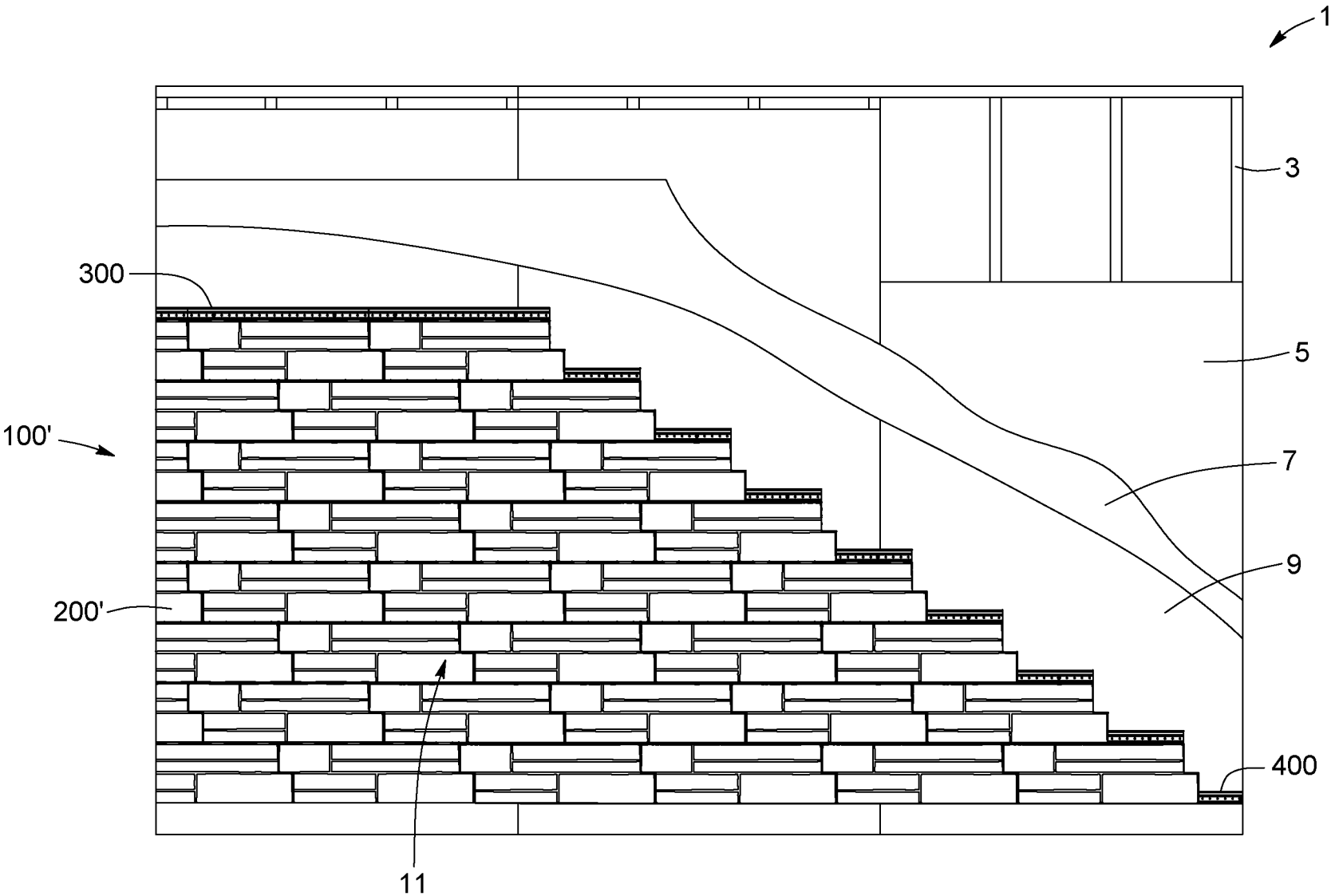
FIG. 7A is a front cutaway view of a veneer assembled on a supporting wall using a cladding system, according to an alternate embodiment in which the cladding system comprises Z-shaped panels.
Figure 7B:
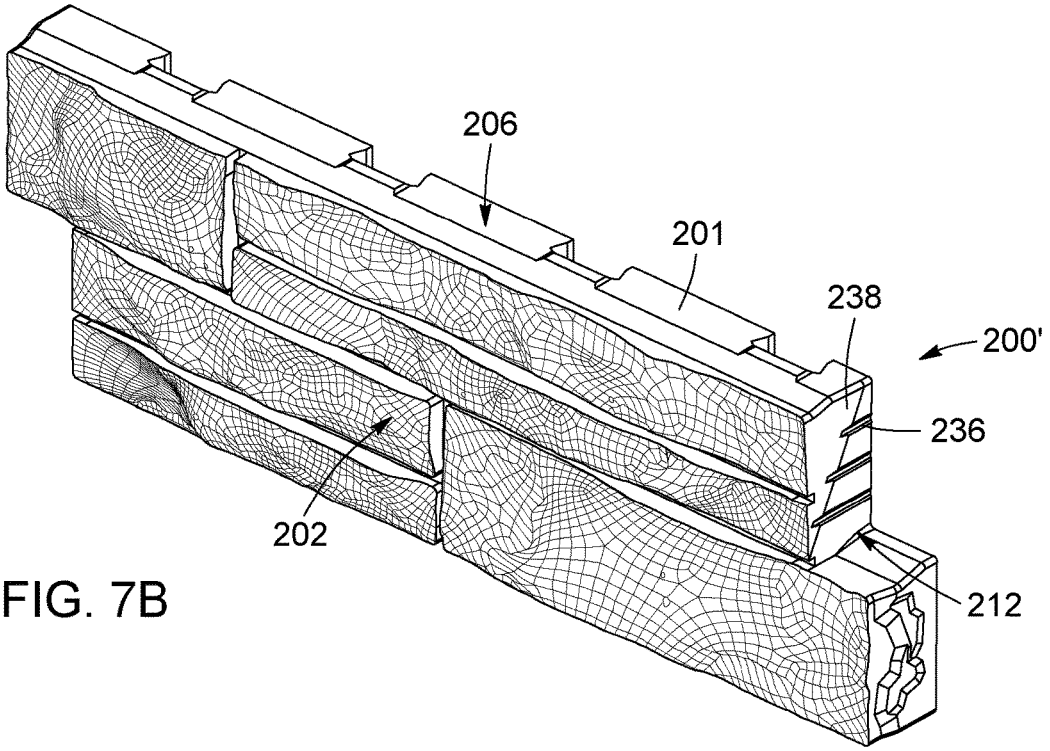
FIG. 7B is a front perspective view of a top edge of a Z-shaped panel used to assemble the veneer of FIG. 7A.
Figure 7C:
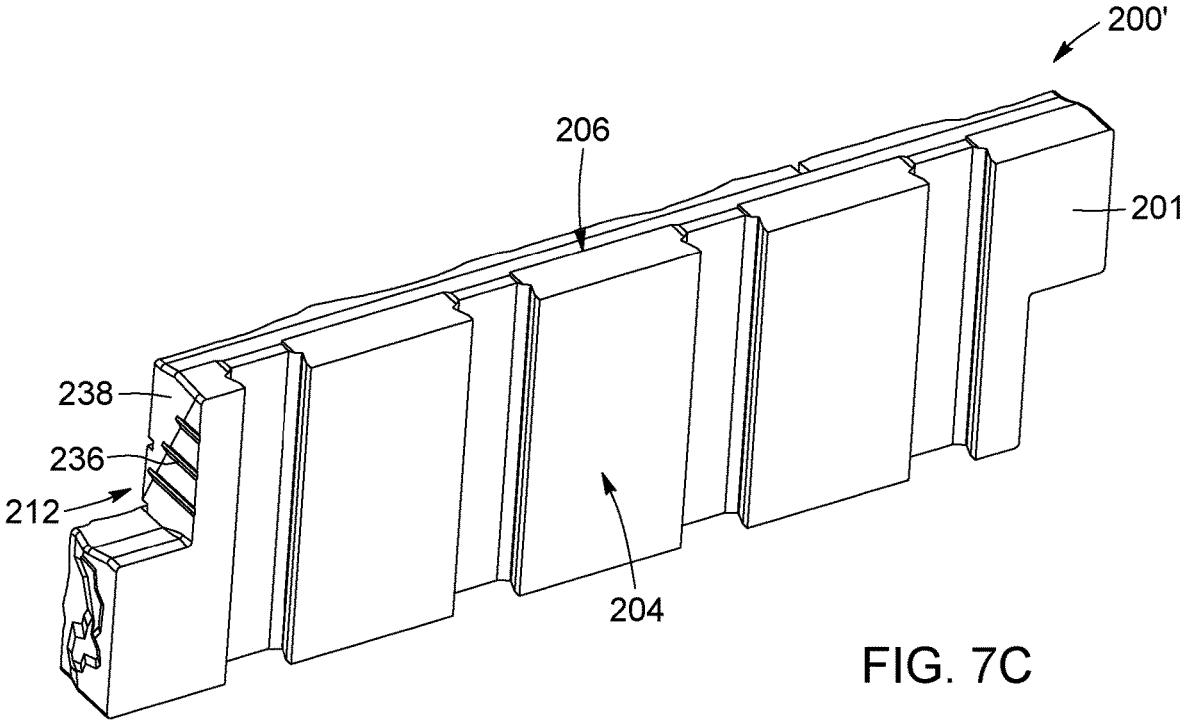
FIG. 7C is a rear perspective view of the top edge of the Z-shaped panel of FIG. 7B.

With reference to FIG. 6C, panel 200*c* is positioned such that its channels 220*c* are offset or out of alignment with the channels 220*a* of panel 200*a*. As can be appreciated, even in this arrangement, the configuration of the panels 200 and anchor 300 allow for water to be effectively drained. As shown schematically by the path 232', water draining from channel 220*c* of upper panel 200*c* will flow along gutter of anchor 300*a*, and will continue to drain through a closest channel 220*a* in lower panel 200*a*. Similarly, as illustrated in FIG. 6B by path 233', water draining through a vertical joint will also flow along gutter of an anchor below, before being drained through a closest channel 220. As described above, the anchor and panel cooperate to direct water arriving at a top edge of a panel to a nearest channel. Therefore, top panel 200*c* can deliver water to panel 200*a* at any location along its top edge, and that water will be directed by the panel and anchor until it reaches the closest channel so that it can continue draining.

As can be appreciated, when panels 200 are stacked, the anchor 300 and edges of adjacent panels 200 cooperate to better secure the panels 200 and to provide improved drainage properties. With reference to FIG. 1D, a cross section of stacked panels 200*a*, 200*c* is shown; the cross section is taken along their aligned channels 220*a*, 220*c*. As illustrated, anchor 300*a* is engaged with panel 200*a*: its panel abutting portion 302*a* abuts along the rear portion of the top face 206*a*, while its tab 304*a* is inserted into the tab receiving portion 226*a*. The tab 304*a* is spaced apart from the interior surface 222*a* of the drainage channel, thus defining an opening 229*a* which allows water from the top face 206*a* to enter the water channelling portion 228*a* of channel 220*a*. When water from the top panel 200*c* drains downward through the water channelling portion 228*c* along the interior surface 222*c*, it will continue to drain through the channelling portion 228*a* of the bottom panel 200*a* through the opening 229*a*. As it does, the angled portion 314*a* of the tab 304*a* will direct the draining water towards the interior surface 222*a* and away from the supporting wall. Top protrusion 216*a* act as a water barrier, preventing water traveling between channels 220*a*, 220*c* from escaping between the panels 200*a* 200*c*. Similarly, protrusion 216*a* prevents water on an exterior of the panels 220*a*, 220*c* from entering between the panels. As can be appreciated, protrusion 216*a* is aligned with channel 220*a*, so that if any water manages to make it past the protrusion 216*a* it can be properly managed through channel 220*a*. Preferably, the height of protrusion 216 is selected such that it acts as a barrier to water while allowing air to pass and creates an open space between top face 206*a* and bottom face 208*c*. In this configuration, a pressure equalization chamber 230 is defined between the panels 200*a*, 200*c*, allowing air to pass between the front 202 and rear 204 faces of the panels 200*a*, 200*c*. This equalizes the pressure on either side of the panels 200*a*, 200*c*, preventing air from actively travelling between the front 202 and rear 204 of the panels, and reducing drafts which would otherwise draw water from the front 202 to the rear 204 of the panels, and potentially into contact with the supporting wall. Laterally adjacent panels can further be spaced apart so that an open space is provided between their left and right faces. This further allows for air to pass between the front 202 and rear 204 sides of the panels, and equalize pressure.

Preferably, the size and distribution of the open spaces described above is chosen so that pressure is uniform across the assembled veneer. Preferably still, the open spaces are configured such that there is a relatively small/negligible pressure differential between the front 202 and rear 204 faces of the panel. In this configuration, when wind blows on the assembled veneer, the flux of air passing between the front 202 and rear 204 faces through the open spaces will be so small that very little water will be blown to the rear of the panels by the wind. As illustrated in FIG. 1A, supporting wall 1 comprises WRB 7. A typical WRB serves to prevent air/wind from passing therethrough, and thus has approximately 10 $mm^2$ to 100 $mm^2$ (or less) of openings per $m^2$ through which air can penetrate (air leakage areas). Preferably, the panels 200 of the assembled veneer 7 are spaced apart (i.e. using spacing elements provided on the anchor 300 and/or on the top/bottom/side faces of the panels 200 to space apart top/bottom/side faces of adjacent panels) such that the assembled veneer 7 has approximately 5,000 $mm^2$ to 10,000 $mm^2$ or more of openings per $m^2$. In this configuration, the veneer has more than 10 times the air leakage areas than the air barrier 9 (and preferably between 100 and 1000 time more), and the pressure differential across the front 202 and rear 204 faces is at least 10 times less than across the front and rear side of the supporting wall 1 (and preferably between 100 to 1000 times less), and thus negligible. Preferably, the spacing between adjacent panels can have a size less than 8 mm, and preferably still approximately 2.5 mm. As one skilled in the art understands, this size may allow for capillary forces to exist between the panels, drawing water from the front 202 and/or rear 204 sides of the panels. Advantageously, the present system manages water drawn by these capillary forces by directing the water to the drainage channels 220. For example, water drawn by capillary forces between left and right edges of laterally adjacent panels will fall until it reaches the top edge 206 of bottom panel 200 (along anchor 300), at which point it will be directed to drain through channel 220.

Although certain embodiments of a cladding (or siding) system have been described hereinabove, it is appreciated that a number of different configurations are possible without departing from the scope of the invention. For example, in the embodiments described above, panels 200 have a substantially rectangular profile. However, as illustrated in FIGS. 7A to 7D, it is appreciated that other forms of panels 200' are possible, such as a Z-shape. Moreover, as illustrated in the panels 200', panel spacing elements 234 can be provided on side edges 210, 212 to space apart side-adjacent panels, and thus aid in allowing air to pass between the panels and into the continuous air gap between the panels and the supporting wall. In the present embodiment, the spacing elements 234 comprise recesses 236 and a chamfer 238 formed on the right edge 212. It is appreciated, however, that other panel spacing elements are also possible.

Figure 8A:
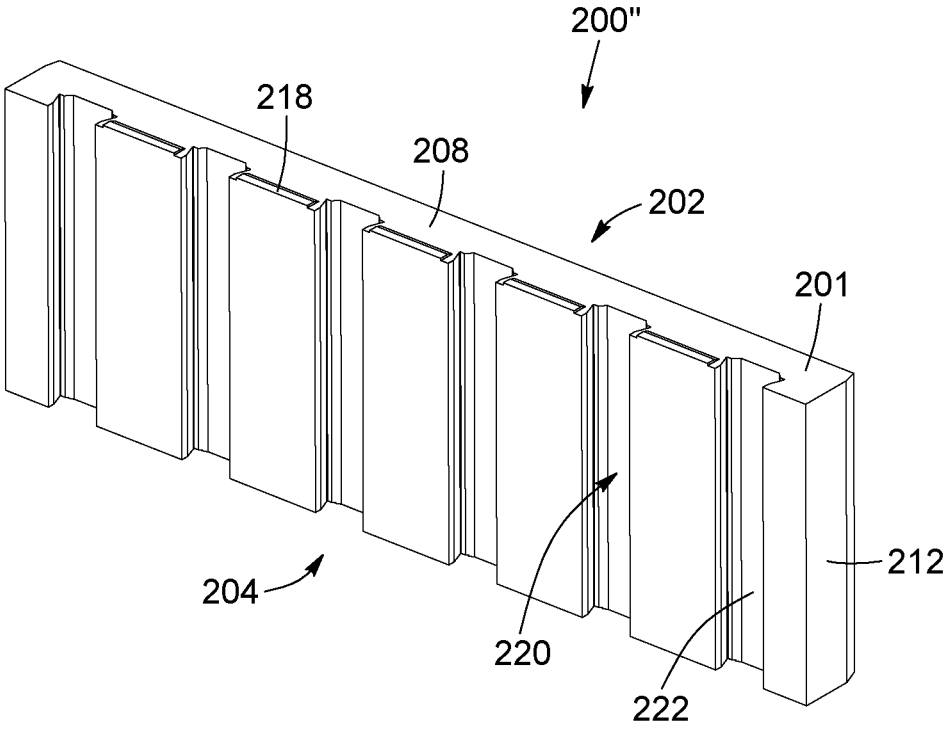
FIG. 8A is a rear perspective view of a bottom edge of a panel according to an alternate embodiment in which the bottom edge is provided with protrusions.
Figure 8B:
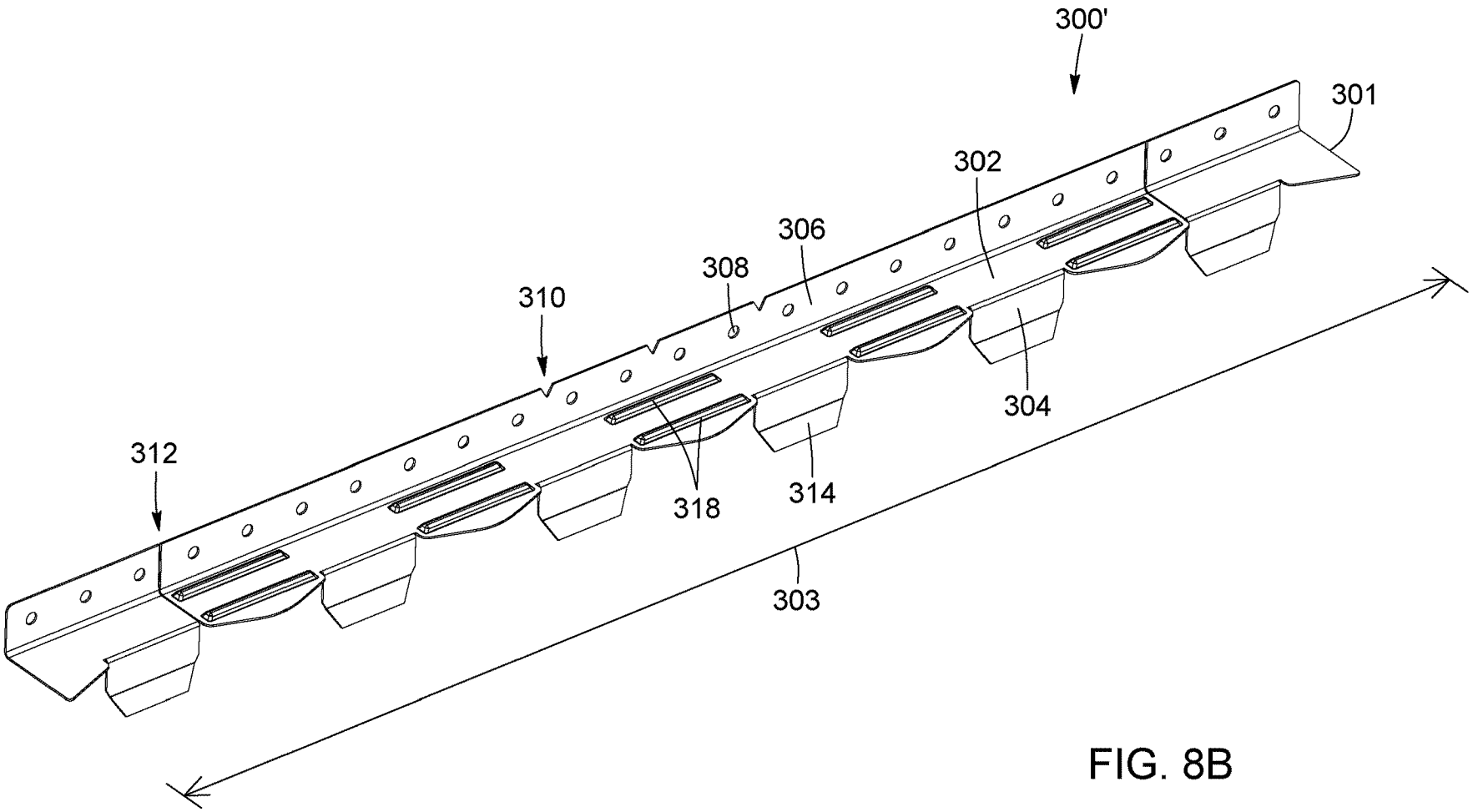
FIG. 8B is a perspective view of an anchor according to an alternate embodiment in which the anchor comprises embossed features for engaging with the protrusions in the bottom edge of a top-adjacent panel.
Figure 8C:
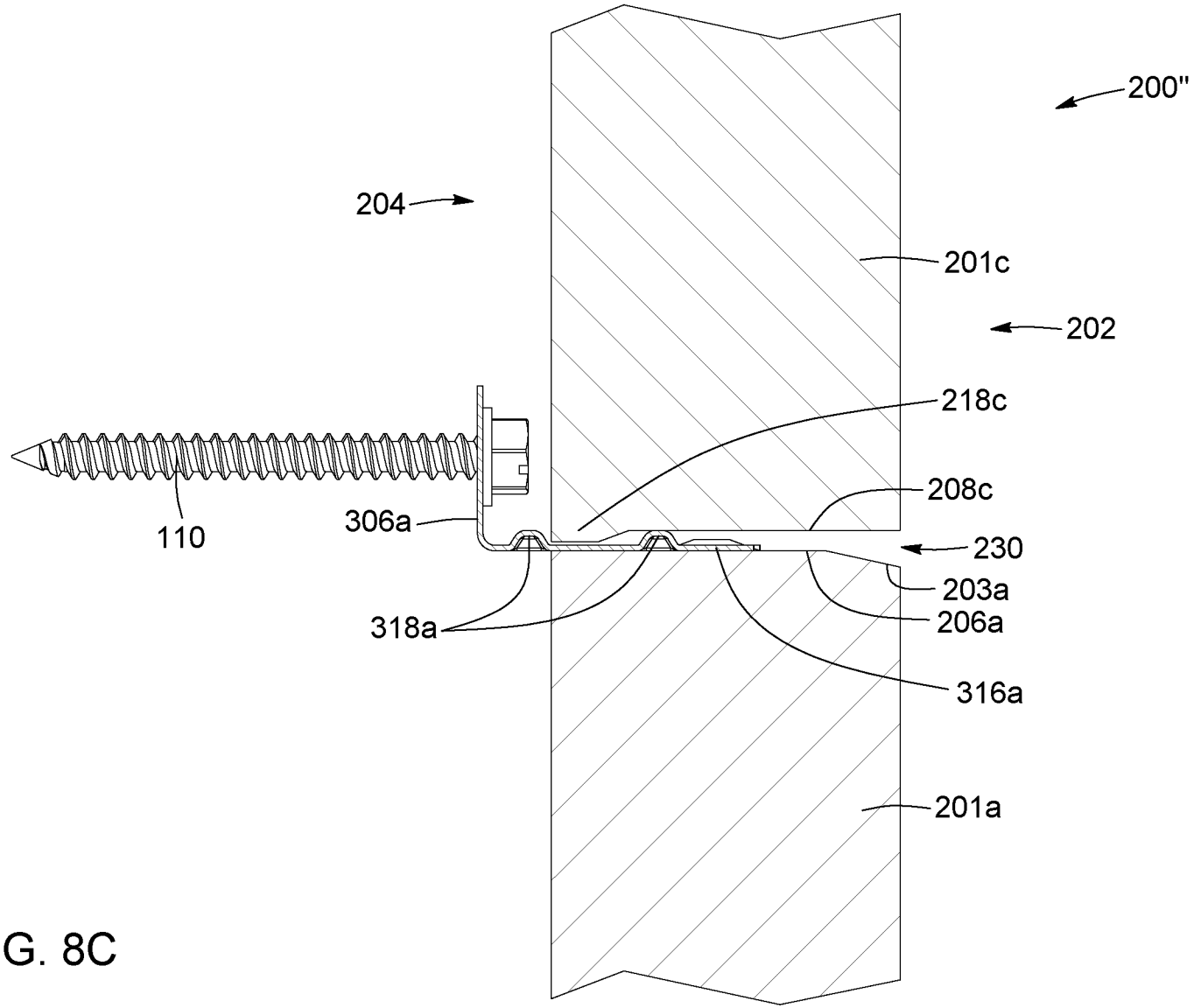
FIG. 8C is a perspective view of a starter anchor according to an alternate embodiment in which the starter anchor engages with bottommost panels via tabs.

Moreover, different configurations of the panels 200 and anchors 300 can be provided to secure panels 200 to supporting wall and prevent push-in/pull-out. For example, as illustrated in the alternate embodiments of panel 200' and anchor 300' in FIGS. 8A to 8C, bottom protrusions 218 can be provided on a bottom edge 208 of panel 200', between the channels 220 and near the rear face 204. Corresponding protrusions or embossed features 318 can be provided in the panel abutting portion 302 of anchor 300' for acting as a stopper to the protrusions 218. As can be appreciated, the embossed features 318 are spaced-apart horizontal ribs configured to receive the panel protrusions 218 therebetween, thus preventing a pull-out and push-through movement of the panels 200, while allowing the panels 200 to slide laterally. In the alternate embodiment of the anchor 300', the mounting plate 306 is provided with notches 310 for acting as visual indicators during installation, for example for aligning the anchor 300 or cutting it to size for corner pieces. Mounting plate 306 is also provided with scored sections 312, to facilitate cutting of the anchor 300' to a desired size.

Figures 8D, 8E:
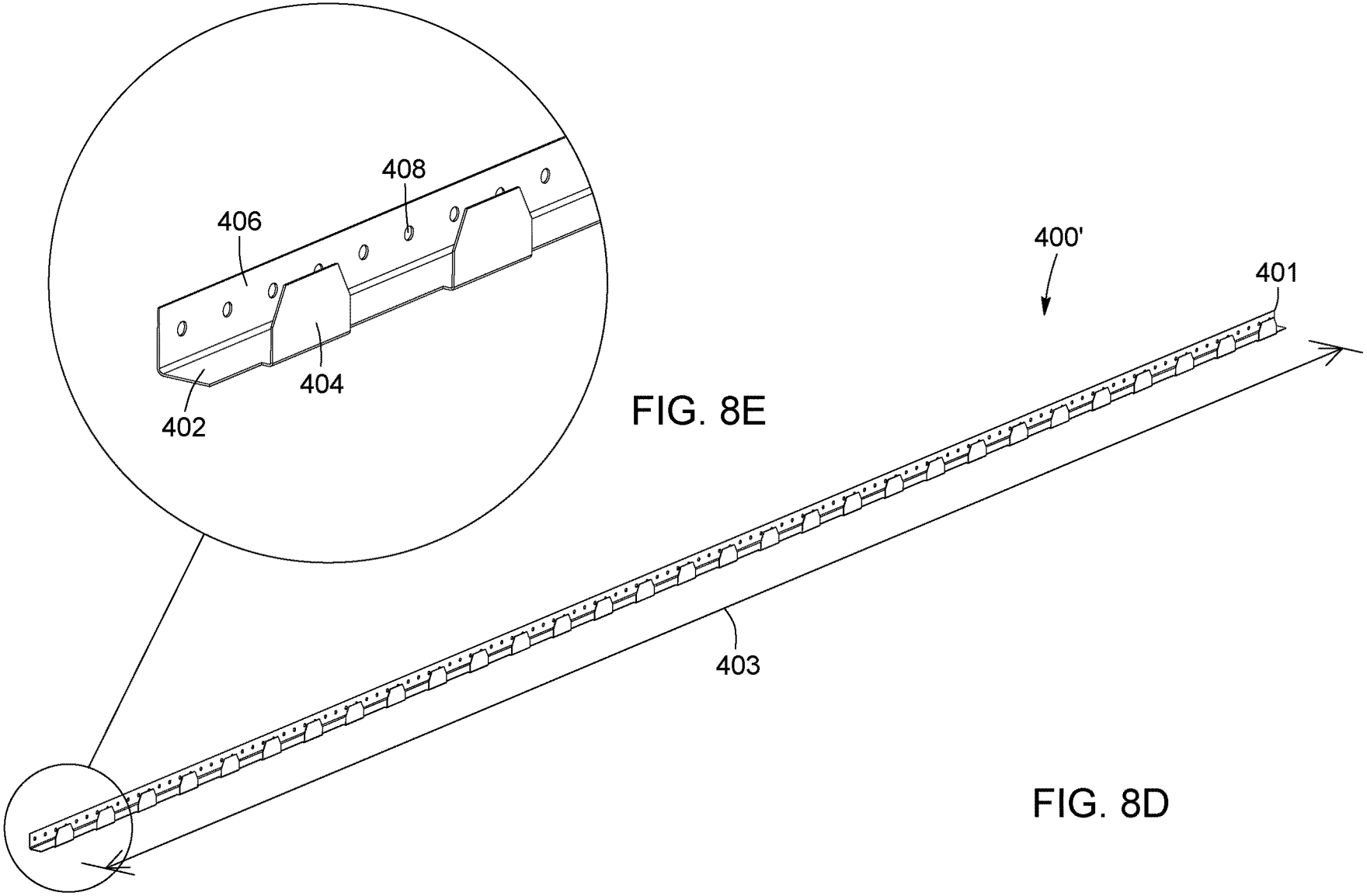
FIG. 8D is a detail view of an end of the starter anchor of FIG. 8C.
FIG. 8E is a cross section showing the embossed features of the anchor of FIG. 8B engaging with the protrusions in the bottom edge of the panel of FIG. 8A.
Figure 8F:
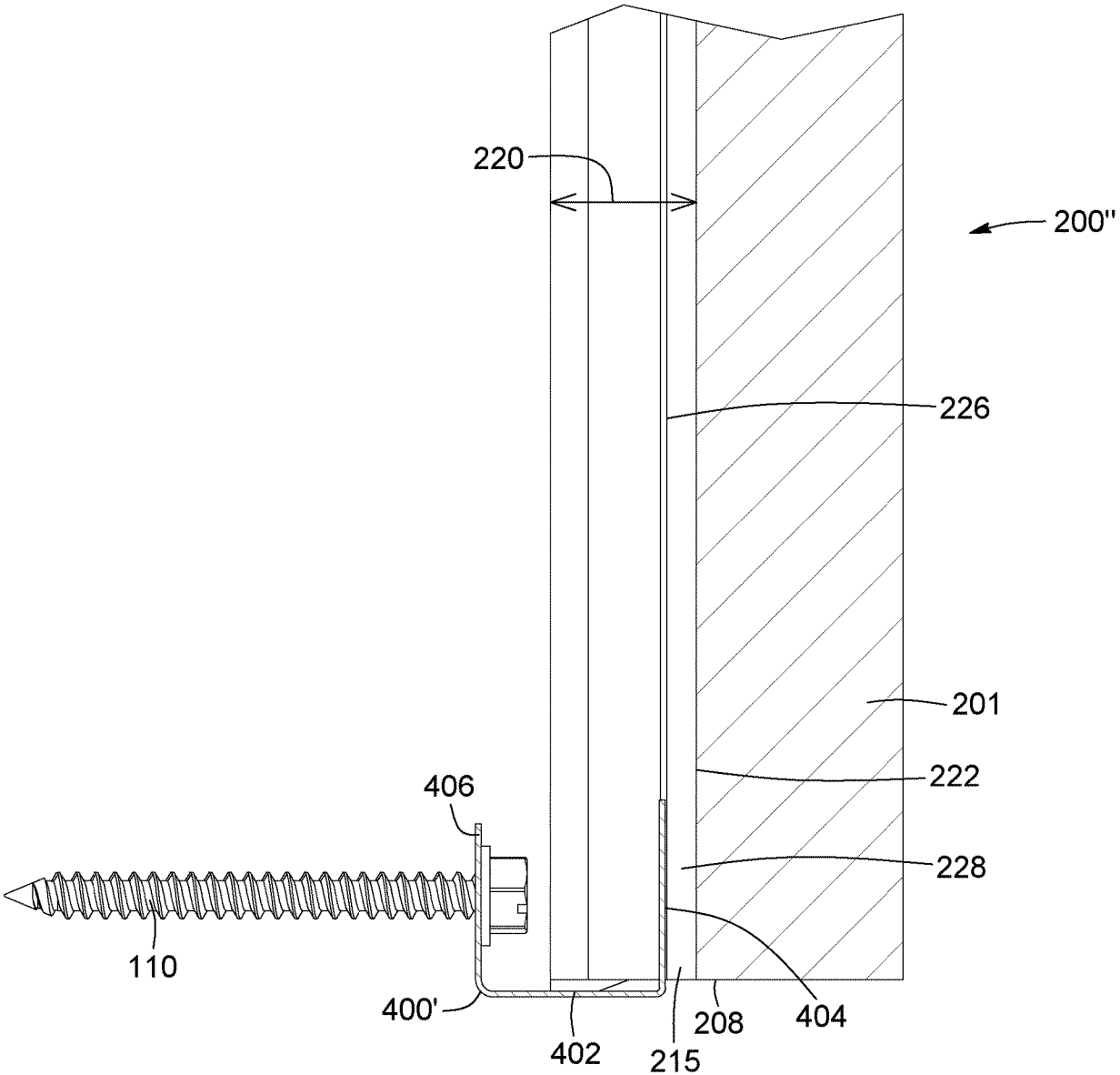
FIG. 8F is a cross section showing the tabs of the starter anchor of FIG. 8C engaged in the channels of a panel.

Different configurations of starter anchor 400 are also possible to support the bottommost row of panels. For example, as illustrated in the alternate embodiment of starter anchor 400' in FIGS. 8D to 8F, the starter anchor 400' can include tabs 404 for engaging with channels 220 of the bottommost panels along a bottom edge thereof. As can be appreciated, in this configuration, bottommost panels will not be able to slide along anchor 400' when engaged therewith.

Figure 9A:
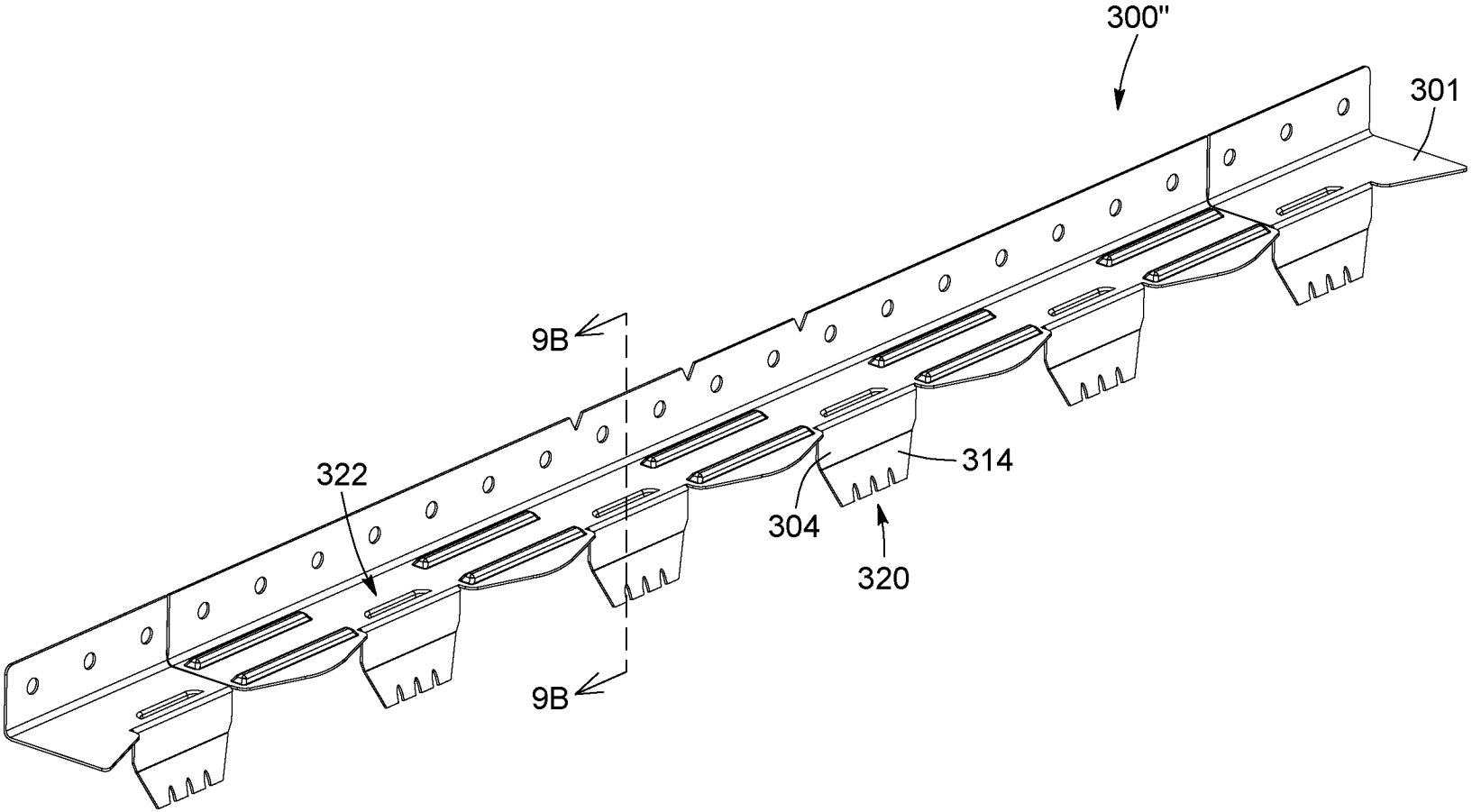
FIG. 9A is a perspective view of an anchor according to an alternate embodiment having water drainage apertures.
Figure 9B:
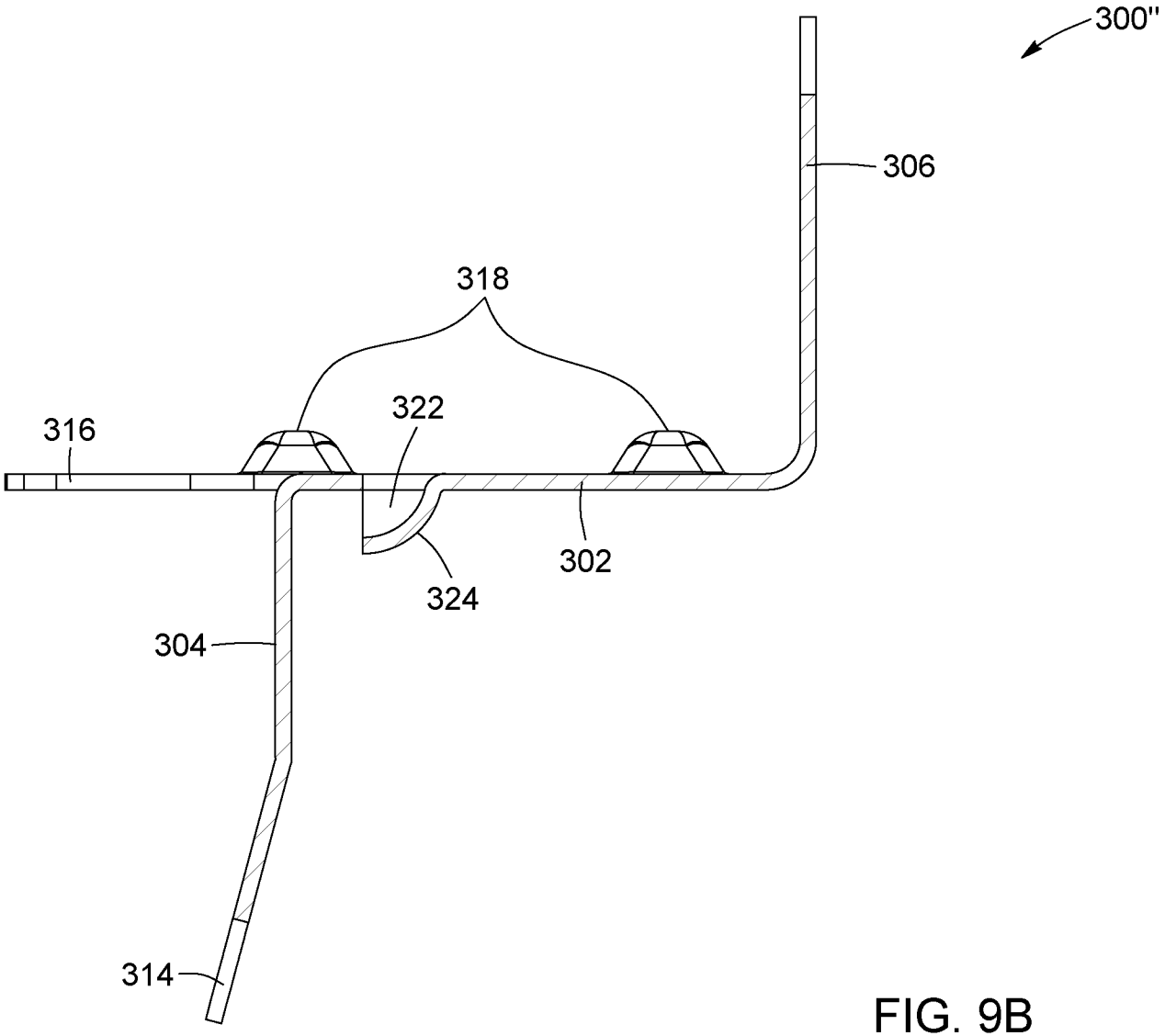
FIG. 9B is a cross section view of the anchor of FIG. 9A taken along line 9B-9B.

In some embodiments, such as the one shown in the alternate embodiment of anchor 300" in FIGS. 9A and 9B, an aperture 322 can be provided in the panel abutting portion 302 for allowing water to flow therethrough. Preferably, the apertures 322 are aligned adjacent the tabs 304, and thus aligned with the drainage channels 220 when the anchor 300" is engaged with a panel 200. In this configuration, water passing through the apertures 322 will continue to drain through the channels 220. The deflector in the anchor 300" further comprises a louver 324 (best shown in FIG. 9B) provided below the aperture 322 for directing water to flow away from the supporting wall, and preferably towards the interior surface 222 of the channel 220.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A cladding system for covering an exterior wall, the cladding system comprising:

a panel assembled with other panels to cover the exterior wall, said panel comprising:

a body having a front face for facing outward, a rear face for facing the exterior wall, and top, bottom and side faces for positioning proximate to edges of adjacent ones of the other panels; and a plurality of drainage channels formed in the rear face of the body, said plurality of drainage channels each having an interior surface spaced apart from the rear face of the body, and opening at least on the top and bottom faces of the body, the channels defining a drainage plane between the front face and the rear face of the body; and an anchor engaged with the panel for securing the panel to the exterior wall, said anchor having an elongated body extending along the top face of the panel, said elongated body comprising:

a plurality of tabs spaced-apart along the elongated body, said tabs respectively fitting in corresponding ones of the drainage channels formed in the panel; and a wall engagement mechanism, for securing the anchor to the exterior wall;

wherein the elongated body of the anchor comprises a gutter portion for collecting liquid on the top face of the panel and directing the liquid to a nearest one of the drainage channels.

2. The cladding system according to claim 1, wherein at least one of the drainage channels in the panel comprises a slotted portion receiving one of the plurality of tabs therein, the slotted portion being spaced apart from the interior surface of a corresponding drainage channel, thereby defining a liquid channeling portion between the interior surface and the tab, allowing liquid on the top face of the panel to flow into the drainage channel.

3. The cladding system according to claim 1, wherein each of the plurality of tabs comprises an angled portion angled towards the interior surface of its corresponding drainage channel, the angled portion directing liquid flowing over the tab towards the interior surface.

4. The cladding system according to claim 1, wherein the body of the panel comprises protrusions formed on its top face, the protrusions being positioned adjacent the openings of the drainage channels on the top face for blocking liquid from entering the drainage channels directly from the front face of the panel.

5. The cladding system according to claim 1, wherein the top face of the panel is sloped downwards from the rear face to the front face.

6. The cladding system according to claim 1, wherein the anchor further comprises a wall spacing element for spacing the rear face of the panel apart from the exterior wall when assembled on the exterior wall, thereby defining a continuous air gap between the rear face of the panel and the exterior wall.

7. The cladding system according to claim 6, further comprising an exterior wall, wherein the exterior wall comprises a weather resistant barrier (WRB) having air leakage areas; wherein the panel further comprises a panel spacing element for maintaining a spacing between at least one of the faces of the panel and at least one face of an adjacent panel; and wherein, when assembled on the exterior wall to form a veneer, the panel spacing elements form at least 10 times more air leakage areas in the veneer than in the WRB.

8. The cladding system according to claim 1, wherein the anchor further comprises a panel spacing element for spacing the top face of the panel apart from the bottom face of a panel vertically stacked thereon by at least 1 mm when assembled on the exterior wall.

9. The cladding system according to claim 8, wherein the panel spacing element comprises wings extending from the elongated body of the anchor, said wings abutting the bottom face of the panel vertically stacked thereon when assembled on the exterior wall, thereby maintaining a spacing between the top face of the panel and the bottom face of the panel vertically stacked thereon, and blocking water from passing therethrough.

10. The cladding system according to claim 9, wherein the wings extend from the elongated body of the anchor at an angle between 10° and 70°.

11. The cladding system according to claim 1, wherein the plurality of drainage channels are in fluid communication with the drainage channels of a top-adjacent panel via the channel opening on the top face when a plurality of said panels are installed adjacently vertical, and with the drainage channels of a bottom-adjacent panel via the drainage channel opening on the bottom face, the cladding system thereby having a continuous drainage path for water via the drainage channels from a top face of a topmost panel to a bottom face of a bottommost panel.

12. The cladding system according to claim 1, wherein the gutter portion has a substantially U-shaped profile and extends along the top face of the panel in an area between the rear face and the interior surfaces of the plurality of channels.

13. The cladding system according to claim 1, wherein the gutter portion has apertures formed therein, said apertures being aligned with the drainage channels for draining liquid collecting on the gutter portion through the drainage channels.

14. The cladding system according to claim 1, further comprising at least one bracket engaged with the panel, the bracket having a body with a panel engagement portion engaged in a corresponding one of the plurality of drainage channels, and an anchor engagement portion for engaging with a bottom-adjacent anchor, the bracket and anchor engaging to prevent a pull-out of the panel relative to the exterior wall.

15. The cladding system according to claim 14, wherein the bracket is engaged in the corresponding one of the plurality of drainage channels via a press-fit in a bottom portion thereof.

16. The cladding system according to claim 14, wherein a wall engagement section of the anchor comprises a mounting plate for mounting to the exterior wall, and the anchor further comprises a bracket engagement portion comprising an elongated track extending from the mounting plate, and wherein an anchor engagement portion of the bracket comprises a substantially U-shaped member shaped to fit over the elongated track and hang therefrom.

17. The cladding system according to claim 16, wherein the elongated track is spaced apart from the mounting plate, and wherein drainage holes are provided in the anchor body between the elongated track and the mounting plate for allowing liquid in a plane of the exterior wall to drain onto the anchor.

18. The cladding system according to claim 16, wherein the bracket engagement portion comprises a panel abutment portion spaced apart from the elongated track, the panel abutment portion abutting against a lower portion of the panel when the panel hangs from the elongated track via the bracket, thereby preventing a push-in of the panel relative to the wall structure.

19. The cladding system according to claim 1, further comprising a starter anchor supporting a bottommost panel when a plurality of said panels are installed adjacently vertical, the starter anchor having an elongated body extending along a bottom face of a bottommost panel, the elongated body comprising:

a mounting plate for mounting to a wall structure; and a ledge portion extending away from the mounting plate, the ledge portion comprising a panel abutting member engaged against the bottom face of the bottommost panel for providing vertical support thereto.

20. The cladding system according to claim 19, wherein the elongated body of the starter anchor further comprises a bracket engagement portion for engaging with a bracket provided in the bottommost panel, the bracket engagement portion comprising an elongated track member extending from the mounting plate.

21. The cladding system according to claim 19, wherein the ledge portion has apertures formed therein for allowing fluid flowing through the bottom face of the bottommost panel to drain therethrough.

22. The cladding system according to claim 1, wherein each of the plurality of drainage channels in the panel is substantially dovetail-shaped.

23. The cladding system according to claim 1, wherein the plurality of drainage channels are parallel to one another and run substantially rectilinearly from the top face of the panel to the bottom face of the panel.

24. The cladding system according to claim 1, wherein the each of the plurality of channels open on the rear face of the panel.

25. The cladding system according to claim 1, wherein the tabs of the anchor have apertures formed in a distal end thereof, said apertures breaking water droplets, preventing a blockage of water flowing into the drainage channels from the tabs and maintaining a laminar flow of water along the interior surfaces of the channels.

26. The cladding system according to claim 1, wherein the front face of the panel has a substantially rectangular profile.

27. The cladding system according to claim 1, wherein the front face of the panel has a substantially Z-shaped profile.

28. The cladding system according to claim 1, wherein the anchor is removably engaged with the panel.

29. The cladding system according to claim 1, wherein the anchor is made of a metal.

30. The cladding system according to claim 1, wherein the panel body is a molded body.

31. A panel for assembling a cladding system on an exterior wall, said panel being securable to the exterior wall, the panel comprising:

a panel body having a front face for facing outward, a rear face for facing the wall structure, and top, bottom and side faces for positioning proximate to faces of adjacent panels;

at least one drainage channel formed in the panel body, said at least one drainage channel having an interior surface spaced apart from the rear face of the panel body, and opening at least on the top and bottom faces of the panel body; and an anchor engaged with the panel body, said anchor having a wall engagement portion for securing the anchor to the wall structure, and a panel engagement portion comprising at least one tab engaged in the at least one drainage channel formed in the panel body;

wherein the anchor comprises a gutter portion for collecting liquid on the top face of the panel body and directing the liquid to the drainage channel.

32. A cladding system assembled on a wall structure using a plurality of panels having drainage channels formed on rear sides thereof, the plurality of panels being secured to the wall structure via anchors engaged with the panels via tabs inserted into the drainage channels, the anchors having a gutter portion extending laterally along a top side of the panels and directing fluid on the top side of the panels towards the drainage channels, the assembled panels defining a drainage plane spaced apart from the wall structure, the drainage plane comprising an uninterrupted path for liquid between a topmost edge of the cladding system to a bottommost edge of the cladding system defined by the drainage channels of vertically stacked panels in fluid communication via the gutter portions of the anchors.

33. The cladding system according to claim 32, wherein the rear sides of the panels are spaced apart from the wall structure, defining a continuous air gap between a rear side of the assembled panels and the wall structure.

34. The cladding system according to claim 32, further comprising a weather resistant barrier (WRB) having air leakage areas, the WRB extending between the wall structure and the rear sides of the panels, and wherein the assembled panels are spaced apart from one another to define at least 10 times more air leakage areas than the WRB.

35. The cladding system according to claim 32, wherein the drainage channels of vertically stacked panels are aligned with one another.

36. The cladding system according to claim 32, wherein the anchors are removably engaged with the panels.

37. A cladding system for covering an exterior wall, the cladding system comprising:

a panel assembled with other panels to cover the exterior wall, said panel comprising:

a body having a front face for facing outward, a rear face for facing the exterior wall, and top, bottom and side faces for positioning proximate to edges of adjacent ones of the other panels; and a plurality of drainage channels formed in the rear face of the body, said plurality of drainage channels each having an interior surface spaced apart from the rear face of the body, and opening at least on the top and bottom faces of the body, the channels defining a drainage plane between the front face and the rear face of the body; and an anchor engaged with the panel for securing the panel to the exterior wall, said anchor having an elongated body extending along the top face of the panel, said elongated body comprising:

a plurality of tabs spaced-apart along the elongated body, said tabs respectively fitting in corresponding ones of the drainage channels formed in the panel; and a wall engagement mechanism, for securing the anchor to the exterior wall;

wherein the anchor further comprises a panel spacing element for spacing the top face of the panel apart from the bottom face of a panel vertically stacked thereon by at least 1 mm when assembled on the exterior wall wherein the panel spacing element comprises wings extending from the elongated body of the anchor, said wings abutting the bottom face of the panel vertically stacked thereon when assembled on the exterior wall, thereby maintaining a spacing between the top face of the panel and the bottom face of the panel vertically stacked thereon, and blocking water from passing therethrough.

38. A cladding system for covering an exterior wall, the cladding system comprising:

a panel assembly with other panels to cover the exterior wall, said panel comprising:

a body having a front face for facing outward, a rear face for facing the exterior wall, and top, bottom and side faces for positioning proximate to edges of adjacent ones of the other panels; and a plurality of drainage channels formed in the rear face of the body, said plurality of drainage channels each having an interior surface spaced apart from the rear face of the body, and opening at least on the top and bottom faces of the body, the channels defining a drainage plane between the front face and the rear face of the body; and an anchor engaged with the panel for securing the panel to the exterior wall, said anchor having an elongated body extending along the top face of the panel, said elongated body comprising:

a plurality of tabs spaced-apart along the elongated body, said tabs respectively fitting in corresponding ones of the drainage channels formed in the panel; and a wall engagement mechanism, for securing the anchor to the exterior wall;

further comprising at least one bracket engaged with the panel, the bracket having a body with a panel engagement portion engaged in a corresponding one of the plurality of drainage channels, and an anchor engagement portion for engaging with a bottom-adjacent anchor, the bracket and anchor engaging to prevent a pull-out of the panel relative to the exterior wall.

39. A cladding system for covering an exterior wall, the cladding system comprising:

a panel assembly with other panels to cover the exterior wall, said panel comprising:

a body having a front face for facing outward, a rear face for facing the exterior wall, and top, bottom and side faces for positioning proximate to edges of adjacent ones of the other panels; and a plurality of drainage channels formed in the rear face of the body, said plurality of drainage channels each having an interior surface spaced apart from the rear face of the body, and opening at least on the top and bottom faces of the body, the channels defining a drainage plane between the front face and the rear face of the body; and an anchor engaged with the panel for securing the panel to the exterior wall, said anchor having an elongated body extending along the top face of the panel, said elongated body comprising:

a plurality of tabs spaced-apart along the elongated body, said tabs respectively fitting in corresponding ones of the drainage channels formed in the panel; and a wall engagement mechanism, for securing the anchor to the exterior wall;

further comprising a starter anchor supporting a bottom-most panel, the starter anchor having an elongated body extending along a bottom face of a bottommost panel, the elongated body comprising:

a mounting plate for mounting to the wall; and a ledge portion extending away from the mounting plate, the ledge portion comprising a panel abutting member engaging against the bottom face of the bottommost panel for providing vertical support thereto;

wherein the elongated body of the starter anchor further comprises a bracket engagement portion for engaging with a bracket provided in the bottommost panel, the bracket engagement portion comprising an elongated track member extending from the mounting plate.

40. A cladding system for covering an exterior wall, the cladding system comprising:

a panel assembly with other panels to cover the exterior wall, said panel comprising:

a body having a front face for facing outward, a rear face for facing the exterior wall, and top, bottom and side faces for positioning proximate to edges of adjacent ones of the other panels; and a plurality of drainage channels formed in the rear face of the body, said plurality of drainage channels each having an interior surface spaced apart from the rear face of the body, and opening at least on the top and bottom faces of the body, the channels defining a drainage plane between the front face and the rear face of the body; and an anchor engaged with the panel for securing the panel to the exterior wall, said anchor having an elongated body extending along the top face of the panel, said elongated body comprising:

a plurality of tabs spaced-apart along the elongated body, said tabs respectively fitting in corresponding ones of the drainage channels formed in the panel; and a wall engagement mechanism, for securing the anchor to the exterior wall;

wherein the tabs of the anchor have apertures formed in a distal end thereof, said apertures breaking water droplets, preventing a blockage of water flowing into the drainage channels from the tabs and maintaining a laminar flow of water along the interior surfaces of the channels.

* * * * *